United States Patent [19]

Crowley et al.

[11] Patent Number: 4,583,301

[45] Date of Patent: Apr. 22, 1986

[54] VARIABLE VOLUME VACUUM DRYING CHAMBER

[75] Inventors: J. David Crowley, Dundas; Glen A. Pearce, Rockwood, both of Canada

[73] Assignee: U-OP Management & Consultants Ltd., Orangeville, Canada

[21] Appl. No.: 618,802

[22] Filed: Jun. 8, 1984

Related U.S. Application Data

[63] Continuation-in-part of Ser. No. 461,071, Jan. 26, 1983, abandoned.

[30] Foreign Application Priority Data

Jan. 26, 1984 [CA] Canada ..... 446068

[51] Int. Cl.[4] ..... F26B 19/00; F26B 21/10

[52] U.S. Cl. ..... 34/73; 34/92; 34/177; 34/242

[58] Field of Search ..... 34/15, 73, 92, 168, 34/169, 170, 177, 242

[56] References Cited

U.S. PATENT DOCUMENTS

| | | | |
|---|---|---|---|
| 2,283,319 | 5/1942 | Dienst | 34/177 |
| 2,924,273 | 2/1960 | Conley et al. | 159/12 |
| 3,108,738 | 10/1963 | Luhmann | 230/79 |
| 3,253,351 | 5/1966 | Bettanin | 34/92 |
| 3,267,585 | 8/1966 | Futer | 34/20 |
| 3,280,473 | 10/1966 | Sullivan | 34/92 |
| 3,300,873 | 1/1967 | Bussell et al. | 34/168 |
| 3,667,626 | 6/1972 | Torelli et al. | 214/17 B |
| 3,672,068 | 6/1972 | Wilkison | 34/15 |
| 3,742,614 | 7/1973 | Bettermann et al. | 34/92 |
| 3,805,406 | 4/1974 | Castonoli | 34/109 |
| 3,833,315 | 9/1974 | Fitch | 417/68 |
| 3,856,493 | 12/1974 | Bulkley | 62/401 |
| 3,889,389 | 6/1975 | Serup | 34/92 |
| 3,914,874 | 10/1975 | Bruce | 34/15 |
| 3,927,715 | 12/1975 | Castanoli | 165/120 |
| 4,015,341 | 4/1977 | McKinney et al. | 34/4 |
| 4,094,075 | 6/1978 | Caruso | 34/72 |
| 4,193,756 | 3/1980 | Leon | 34/242 |
| 4,225,288 | 9/1980 | Mugele et al. | 417/2 |
| 4,229,886 | 10/1980 | Durant | 34/92 |
| 4,241,517 | 12/1980 | Carpenter | 34/79 |
| 4,308,669 | 1/1982 | Noyes et al. | 34/33 |
| 4,323,334 | 4/1982 | Haauik | 417/68 |
| 4,343,095 | 8/1982 | Rosen et al. | 34/92 |
| 4,466,198 | 8/1984 | Doll | 34/73 |

FOREIGN PATENT DOCUMENTS

| | | | |
|---|---|---|---|
| 28609 | of 1913 | United Kingdom | 34/177 |

*Primary Examiner*—Albert J. Makay
*Assistant Examiner*—David W. Westphal
*Attorney, Agent, or Firm*—Rogers, Bereskin & Parr

[57] ABSTRACT

An apparatus for reducing the moisture content of a material, such as grain, has a variable volume chamber, which in use is filled with the material. Material within the chamber is heated by heating means to reduce its moisture content. A pumping means is connected to the chamber to pump off fluid from the chamber, whereby a sub-atmospheric pressure can be maintained in the chamber. In use, the pressure differential between the inside and the outside of the chamber is carried by material within the chamber, and the chamber reduces in volume so that no substantial pressure load is carried by walls of the chamber. The heating means can comprise steam pipes extending across the chamber or cylindrical heating elements formed from plates which define ducts for the steam or other heating fluid.

48 Claims, 26 Drawing Figures

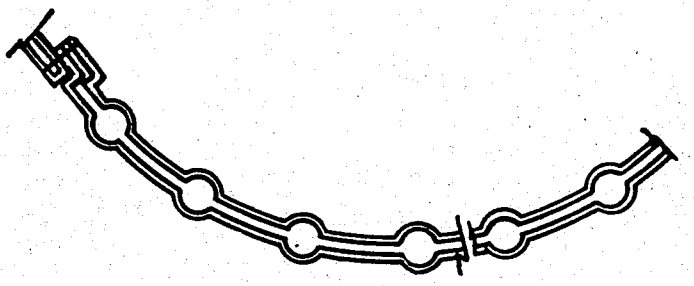
FIG.20
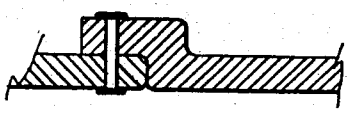
FIG.21
FIG.19
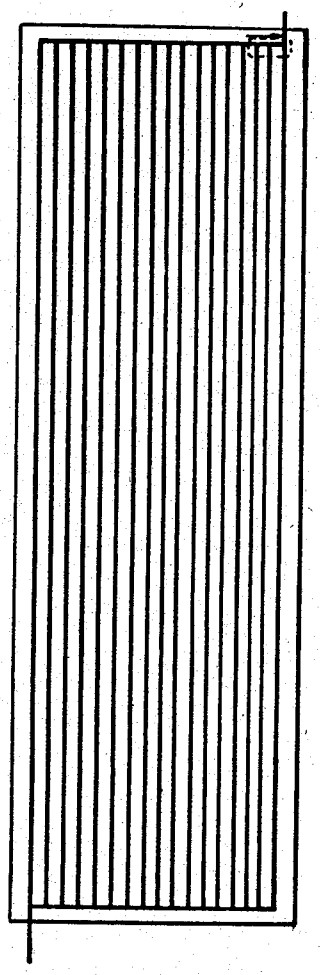

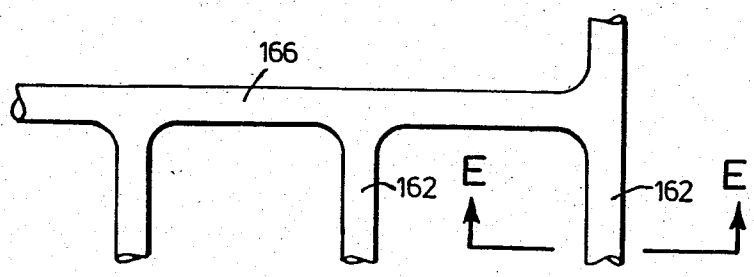
FIG. 22
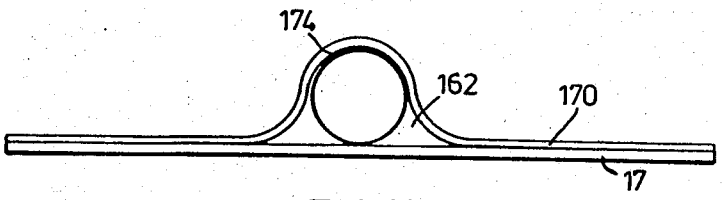
FIG. 23
FIG. 24
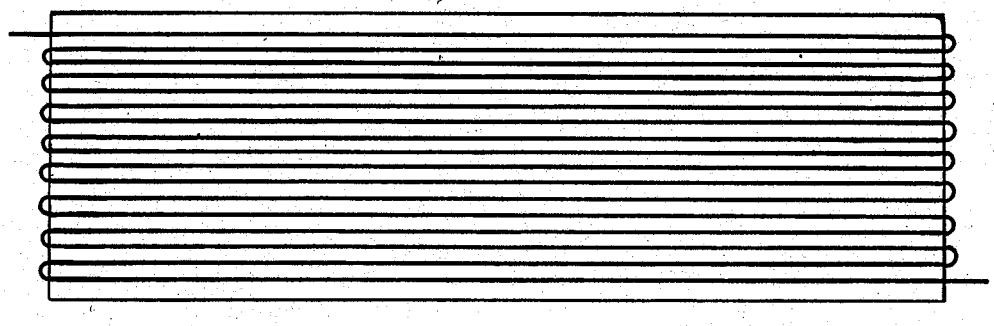

VARIABLE VOLUME VACUUM DRYING CHAMBER

This application is a continuation-in-part of our earlier application 461,071 filed Jan. 26, 1983 now abandoned.

This invention relates to an apparatus for, and a method of, drying grain and other material including granular, particulate, fiberous or solid matter.

It has long been recognized that, in order to store corn and other grain for any length of time, it is necessary to reduce the initial moisture content of the grain by drying. Failure to dry the grain sufficiently can result in the grain rotting. Also, excessive bacterial growth on some materials such as hay and to a lesser extent grain can generate sufficient heat to start a fire.

Whilst small quantities of grain can be dried naturally, large quantities of grain sensibly require some sort of mechanical or assisted drying.

Grain dryers have been in use for many years. In one type of conventional dryer, the grain is fed continuously through the dryer. The grain passes down through panels, in which the layer of grain is maintained at a constant thickness. Hot air is then blown through this layer of grain to dry it. The air is heated by burners supplied with natural gas or another fuel, and centrifugal fans drive the heated air through the grain. Although these dryers can adequately dry grain, they use considerable quantities of fuel, and it is difficult to recover the energy still present in gas exhausted from the dryer.

In a second type of known dryer, it has been shown that grain and other materials could be dried in pressure vessels, in which a sub-atmospheric pressure is maintained by means of a vacuum pump.

In U.S. Pat. No. 3,672,068 (Wilkison) a drying apparatus has a chamber connected to a vacuum pump, so that the pressure in the chamber can be reduced. The pressure is reduced sufficiently so that lower temperatures are needed to bring the temperature of material to be dried in the chamber above the boiling point of water at that pressure. Exhaust heat from the vacuum pump is passed through jackets within the pressure vessel to heat the material to be dried, and thereby to reduce the drying time. It should be noted that the apparatus requires a relatively complex and expensive chamber or pressure vessel, capable of withstanding the difference between the external atmospheric pressure and an internal sub-atmospheric pressure.

In U.S. Pat. No. 4,015,341 (McKinney), corn and similar grains are dried by placing them in a pressure vessel in which a sub-atmospheric pressure is produced by means of a vacuum pump. The grain is irradiated by microwaves so that its temperature is above the boiling temperature of water at the sub-atmospheric pressure. A condenser coil within the pressure vessel condenses water vapor in the vessel, to minimize the energy required for maintaining a vacuum. The apparatus has the disadvantage that again a relatively complex and expensive pressure vessel is required which is capable of withstanding the difference between atmospheric pressure and the sub-atmospheric pressure within the vessel. Also, the heat given off by the condensation of water vapor on the condenser coils is lost and not recovered.

U.S. Pat. No. 4,229,886 (Durant) is somewhat similar to U.S. Pat. No. 4,015,341. It includes a pressure vessel, in which material to be dried is conveyed on a conveyer belt and irradiated with microwaves. It also has input and output augers capable of supplying material to and removing it from the vessel continuously whilst a vacuum is maintained in the vessel. Again, a condenser coil carrying cold water is provided for removing water vapor within the pressure vessel. The pressure vessel is a relatively complex and expensive part of the apparatus, and no means are provided for recovering the energy given off by the condensing water vapor, this energy being lost.

According to the present invention there is provided an apparatus for reducing the moisture content of a material, the apparatus comprising a variable volume chamber, in which the moisture content of material is reduced and which has walls; heating means to heat material within the chamber; and pumping means connected to the chamber for pumping fluid from the chamber.

In use, the chamber is filled with material, the pumping means pumps fluid from the chamber so that a sub-atmospheric pressure obtains therein, the variable volume chamber reduces in volume so that external pressure is transmitted to the material within the chamber such that no substantial pressure load is carried by the walls of the chamber, and material within the chamber is heated by the heating means to reduce its moisture content. The material can be heated by the heating means to a temperature in the range 25°–80° C. It is to be appreciated that the fluid can be one or more of liquid, gas and vapor. The material could be any granular particulate, fibrous or solid matter capable of supporting an external pressure load and thus providing structural integrity to the variable volume chamber. As the walls need not be capable of withstanding any great pressure differential, thinner walls can be used which has costs advantages. It also improves heat transfer and facilitates the heating of the chamber by the use of an external jacket.

It is possible for the heat or heating means to be provided a source within the chamber, such as chemical biological or biochemical reactions, and the term "heating means" as used in this specification, including the claims, is to be construed as covering such an internal heat source.

To reduce the power required for the pumps, a condenser can be provided between the chamber and the pumps. The condenser condenses out water vapor, which is then separated. Consequently, the volume of gas or vapor passing to the pumps is considerably reduced, so that smaller pumps are required. Additionally, heat extracted from the condenser can be used to preheat grain being fed to the chamber. To improve heat transfer to the grain, the chamber can be provided with means for supplying and extracting air or other gas/vapor to the chamber. Then the chamber can be operated cyclically; the chamber is alternately subjected to a sub-atmospheric pressure to draw off moisture, and heated with air present.

For a better understanding of the present invention and to show more clearly how it may be carried into effect, reference will now be made, by way of example, to the accompanying drawings, which show preferred embodiments and in which.

Figure 3B:
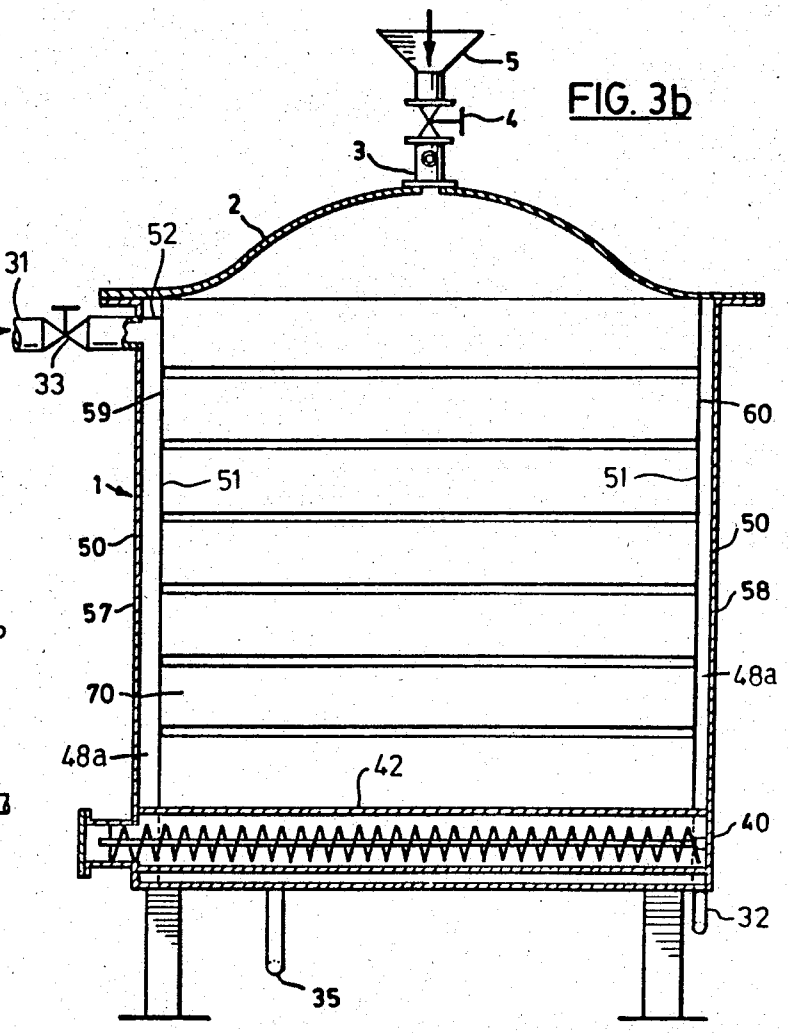
Figure 3A:
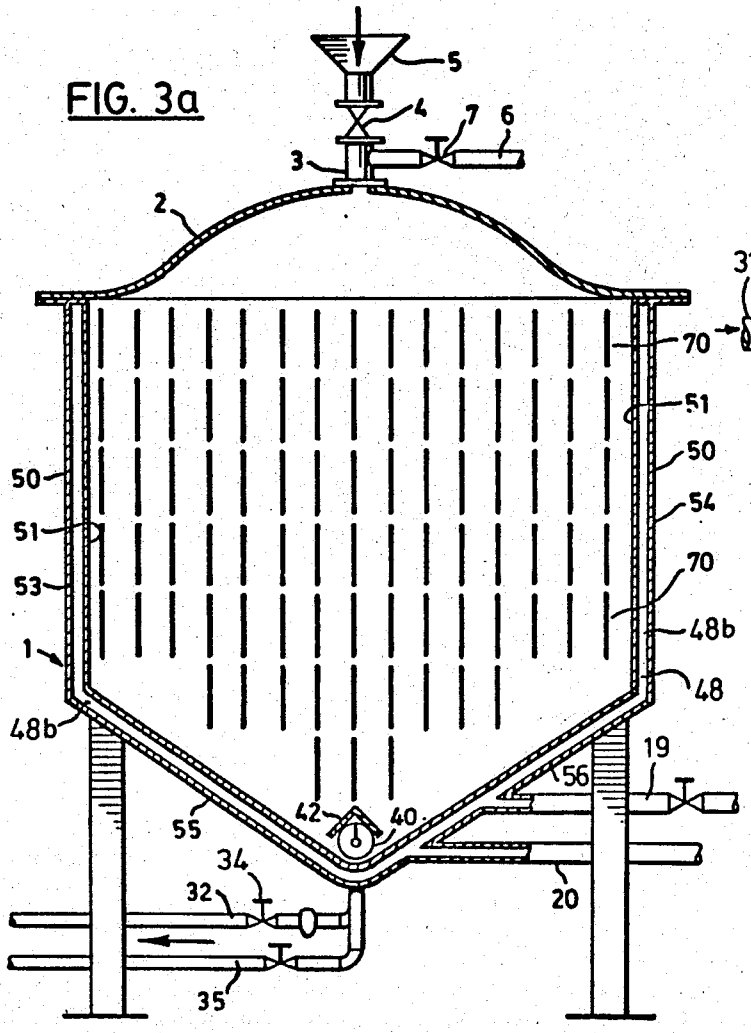

FIG. 3*a* shows a vertical cross-section through a first embodiment of a variable volume chamber;

FIG. 3*b* shows a vertical cross-section through the first embodiment of the variable volume chamber, perpendicular to the section of FIG. 3*a;*

Figure 4:
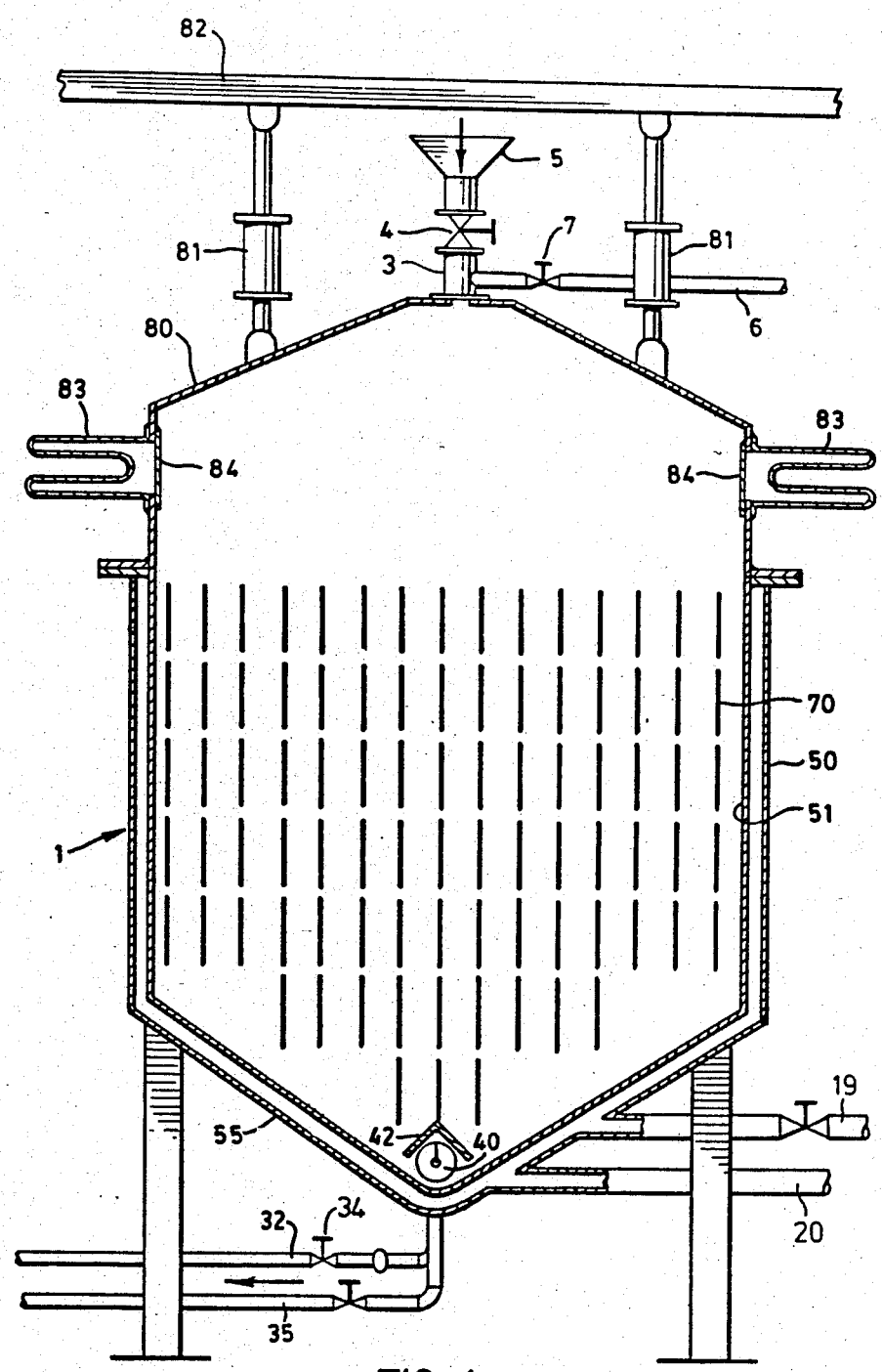
Figure 5:
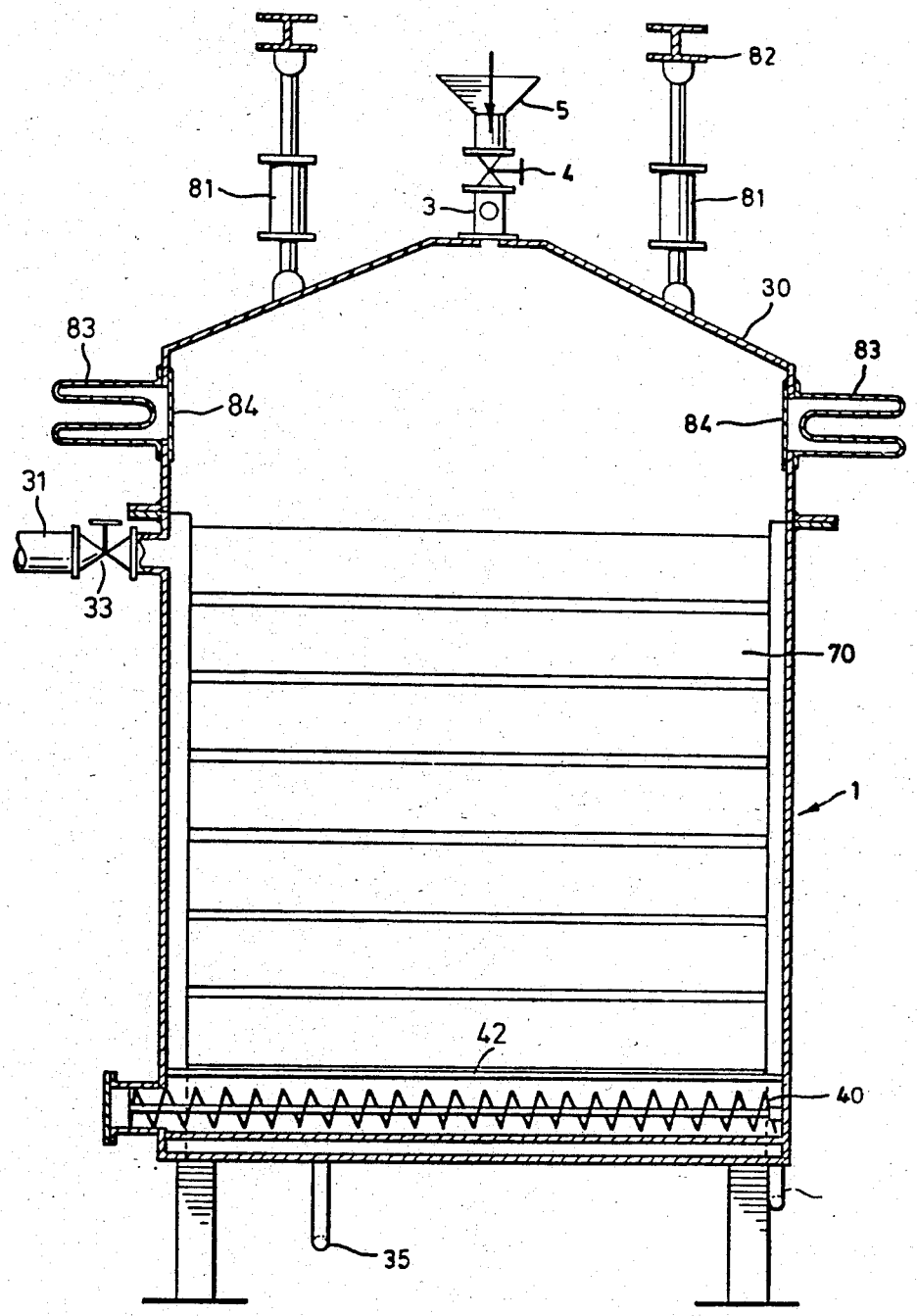
Figure 6:
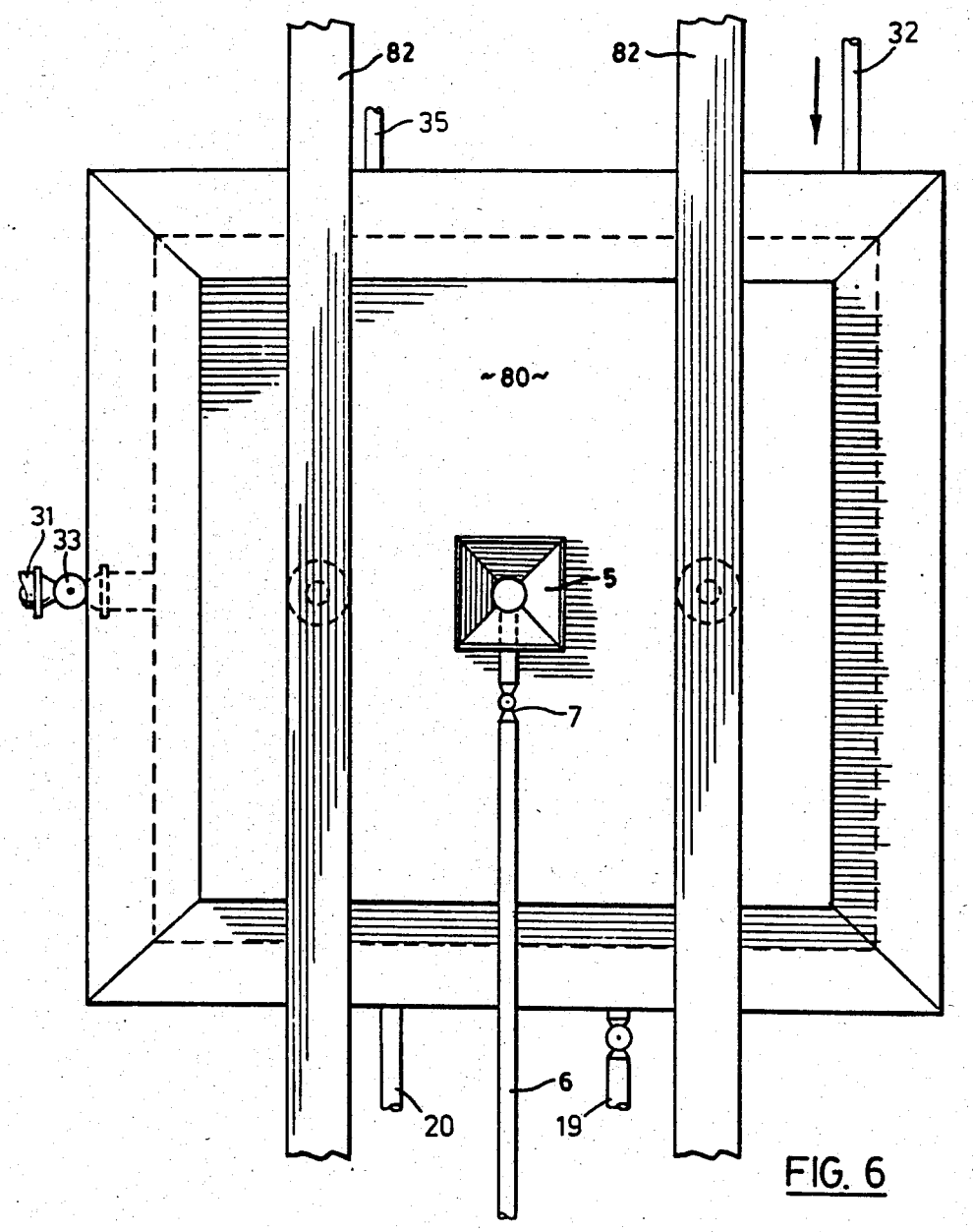
Figure 7:
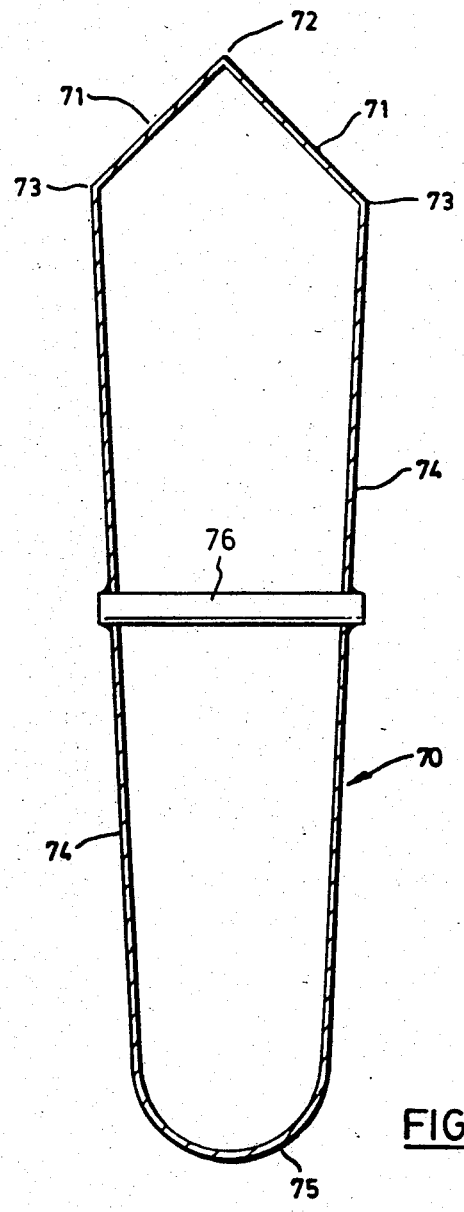
Figure 8:
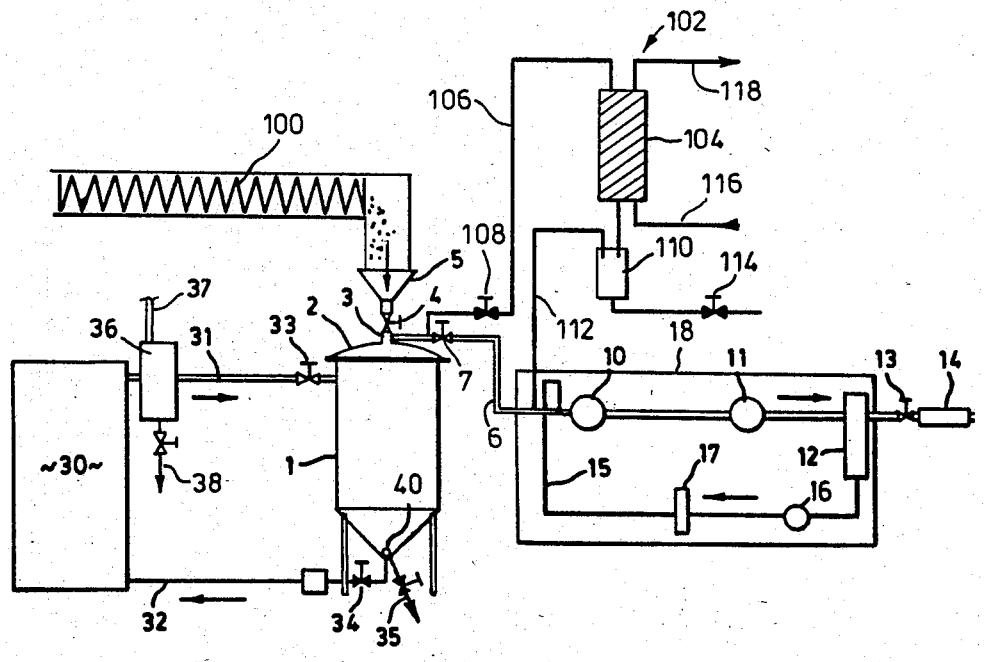
Figure 9:
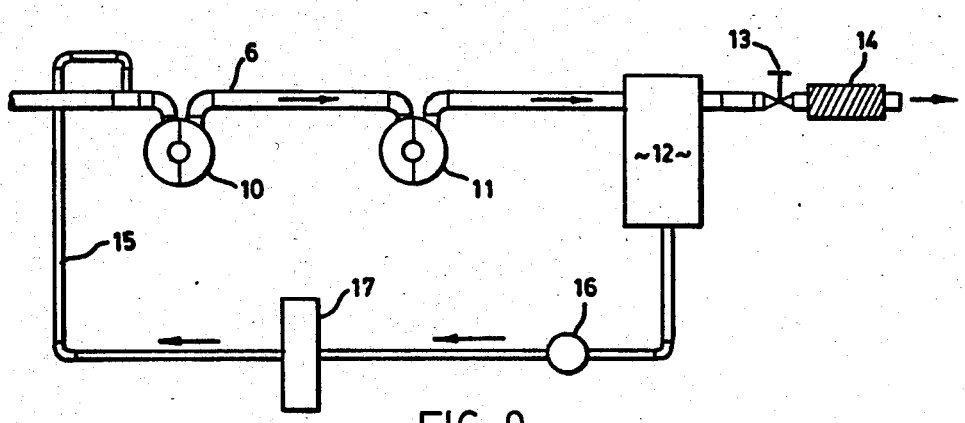
Figure 10:
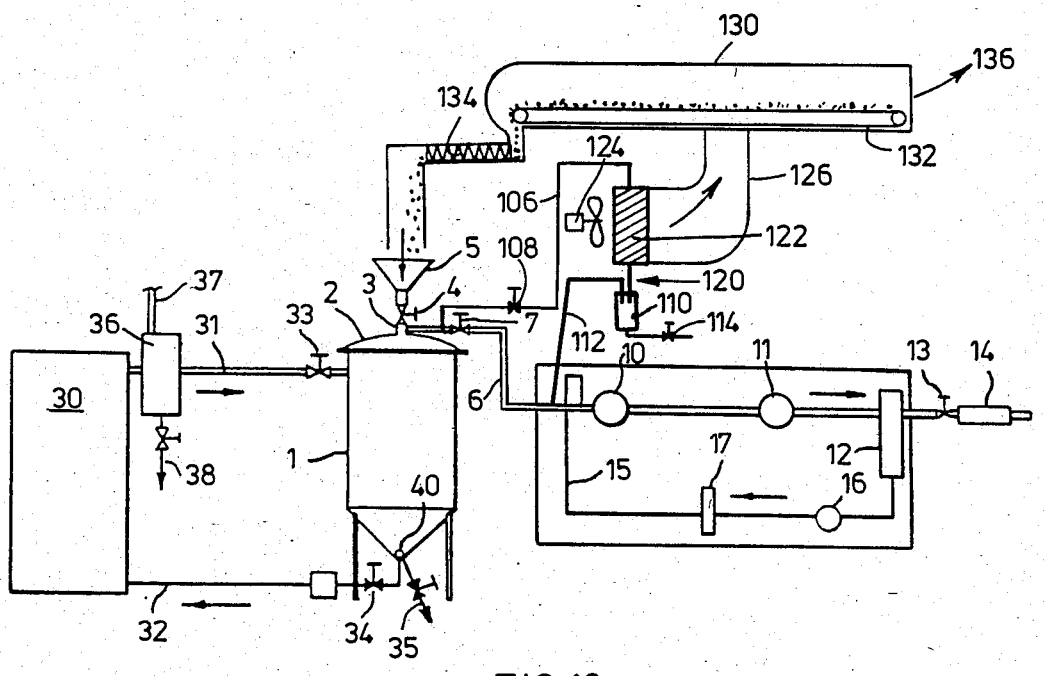
Figure 11B:
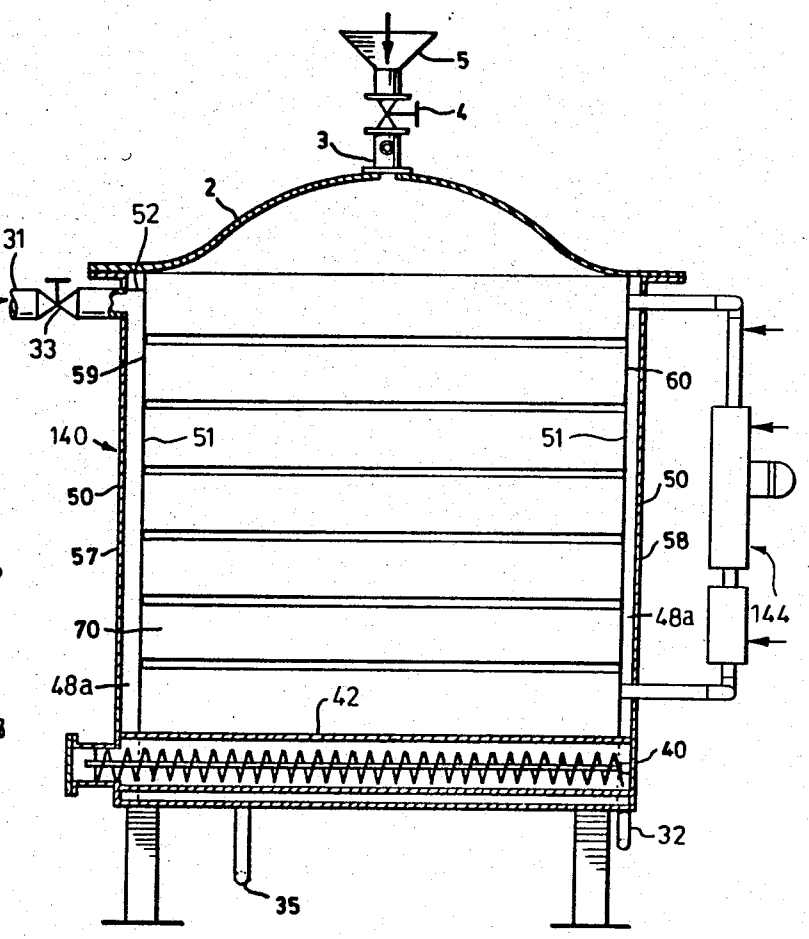
Figure 11A:
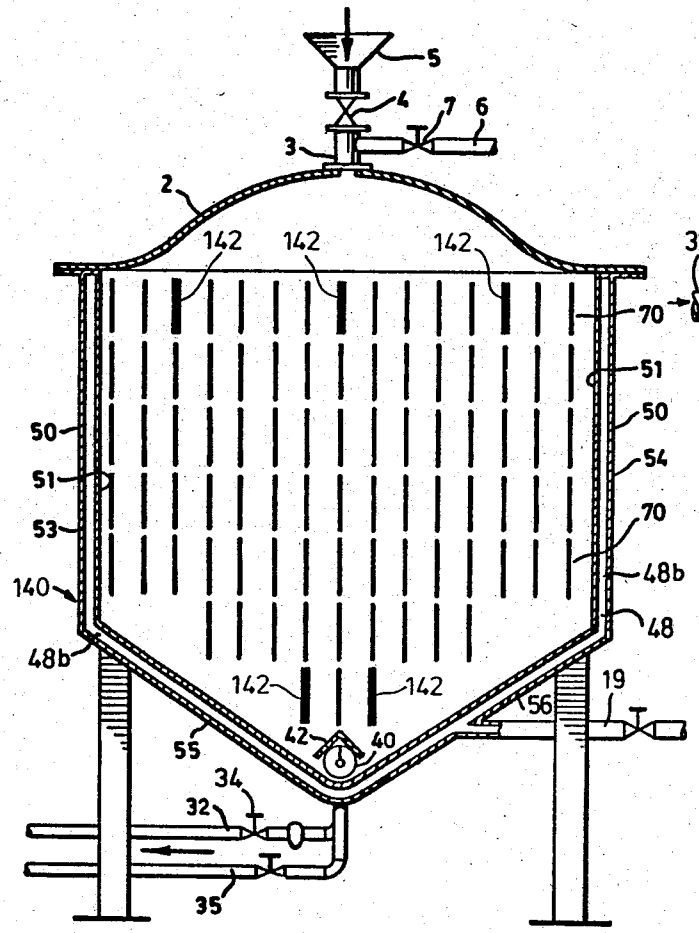

FIG. 4 shows a cross-section through a second embodiment of a variable volume chamber;

FIG. 5 shows a vertical cross-section through the second embodiment of the variable volume chamber, perpendicular to the cross-section of FIG. 4;

FIG. 6 shows a plan view of the second embodiment of the variable volume chamber;

FIG. 7 shows a cross-section through a heating tube for the variable volume chamber;

FIG. 8 shows diagramatically an apparatus according to a second embodiment of the present invention;

FIG. 9 shows diagramatically the details of the pumping means of FIG. 8;

FIG. 10 shows a third embodiment of the apparatus according to the present invention;

FIG. 11*a* shows a vertical cross-section through a third embodiment of the variable volume chamber;

FIG. 11*b* shows a vertical cross-section through the third embodiment of the variable volume chamber, perpendicular to the section of FIG. 11*a;*

Figure 12:
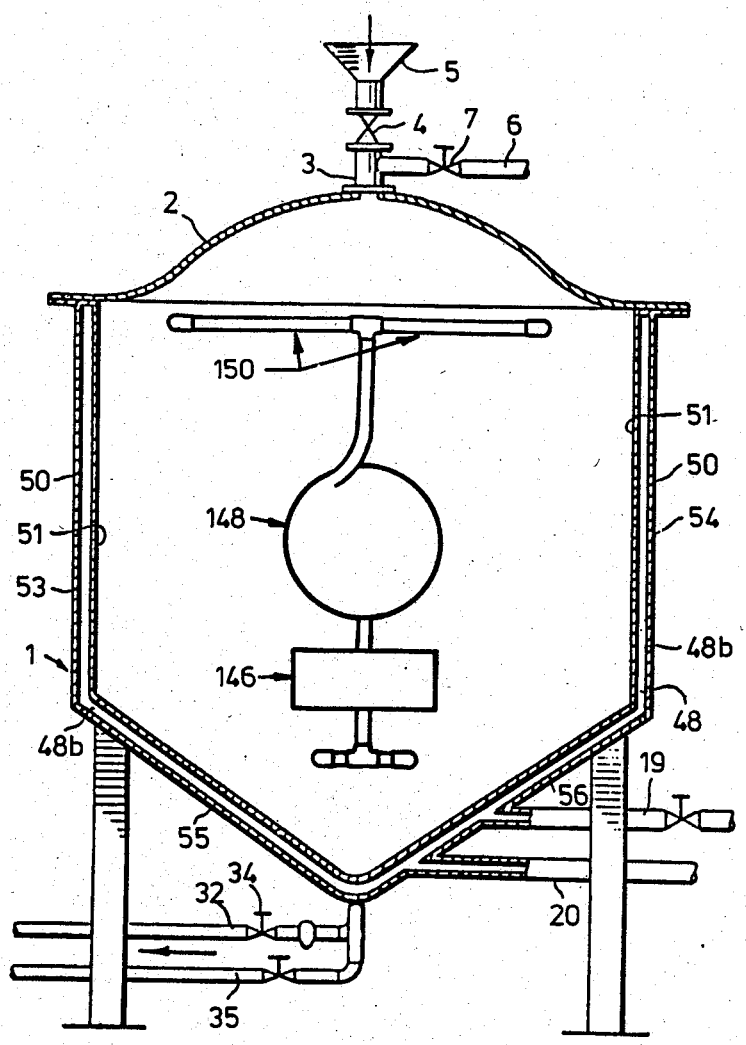
Figure 13:
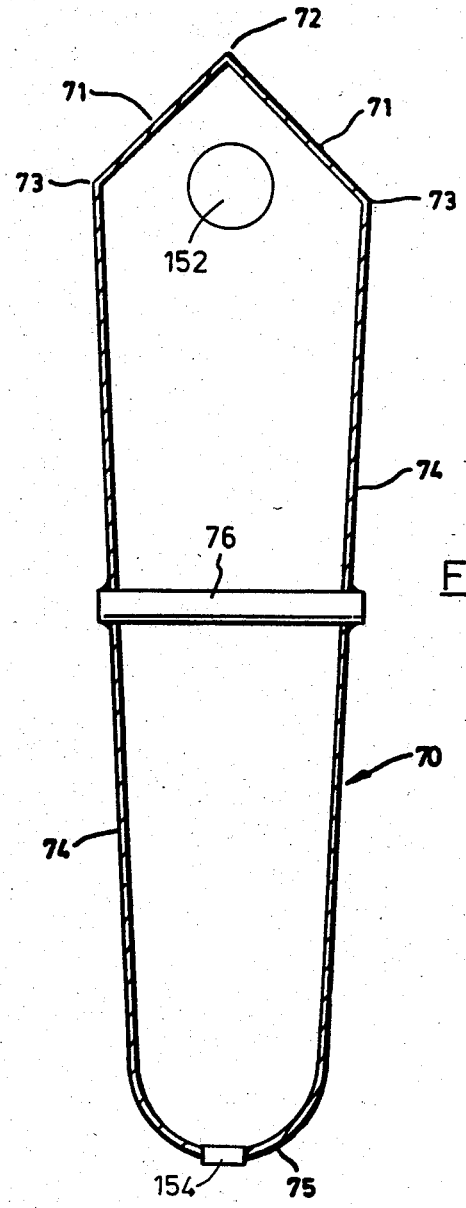
Figure 14:
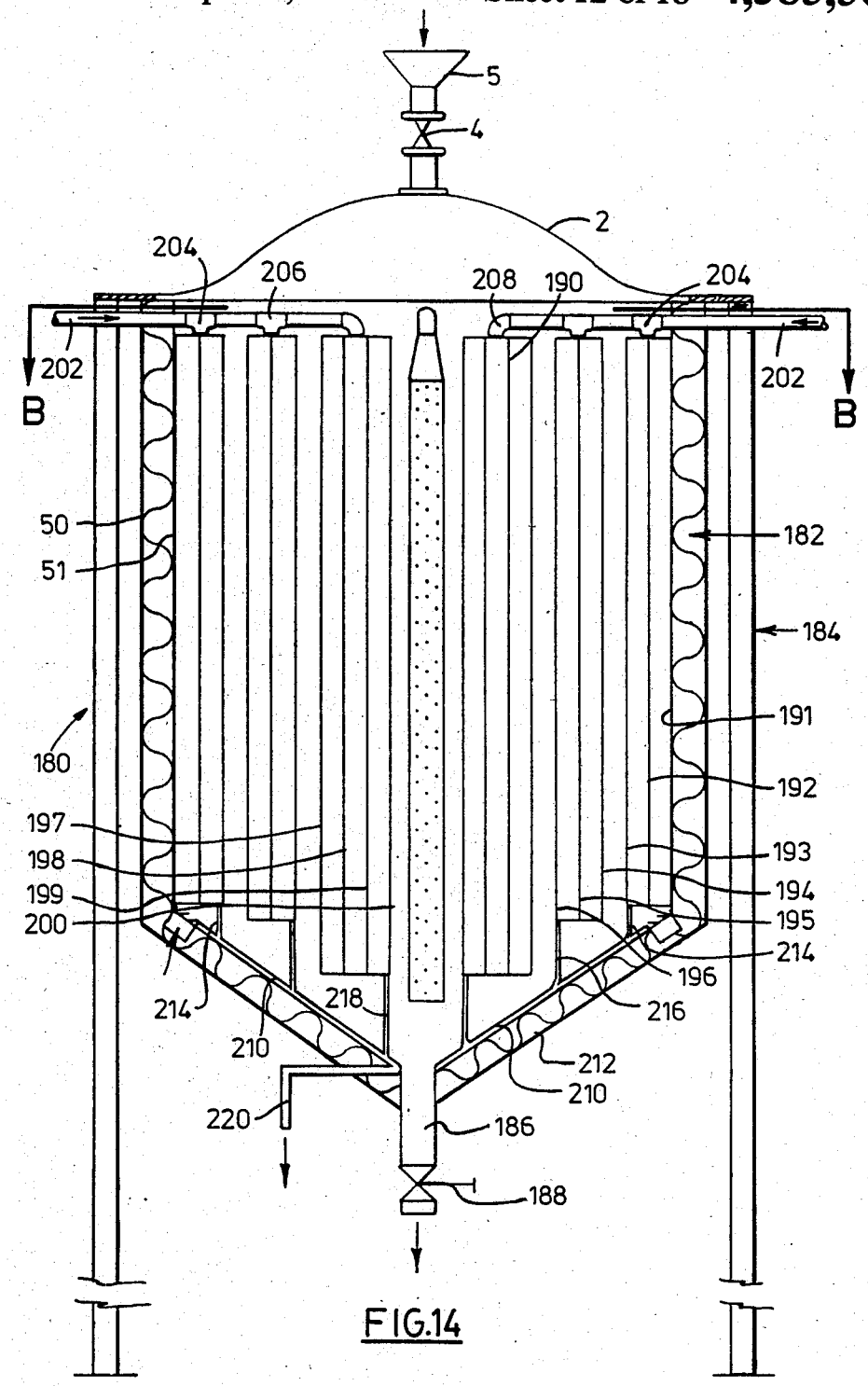
Figure 15:
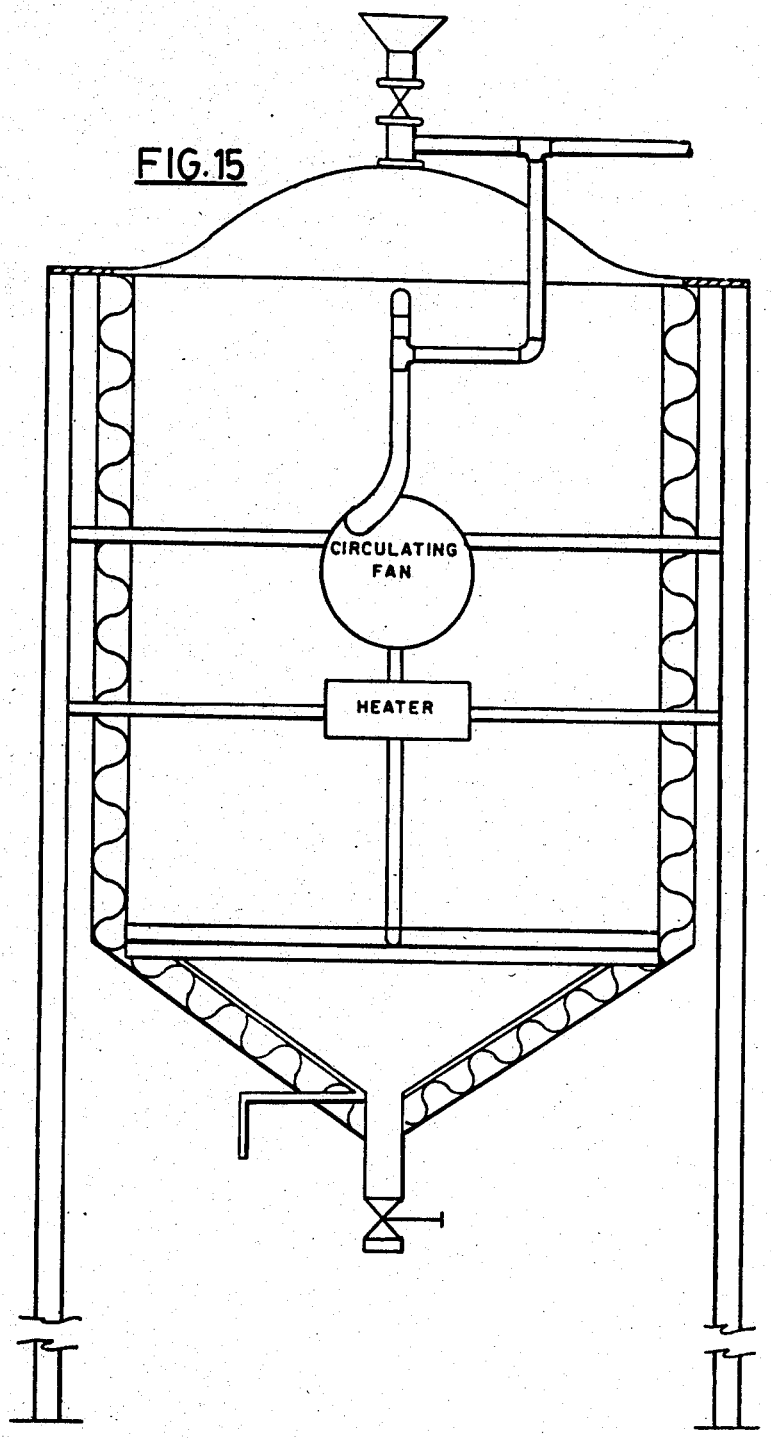
Figure 16:
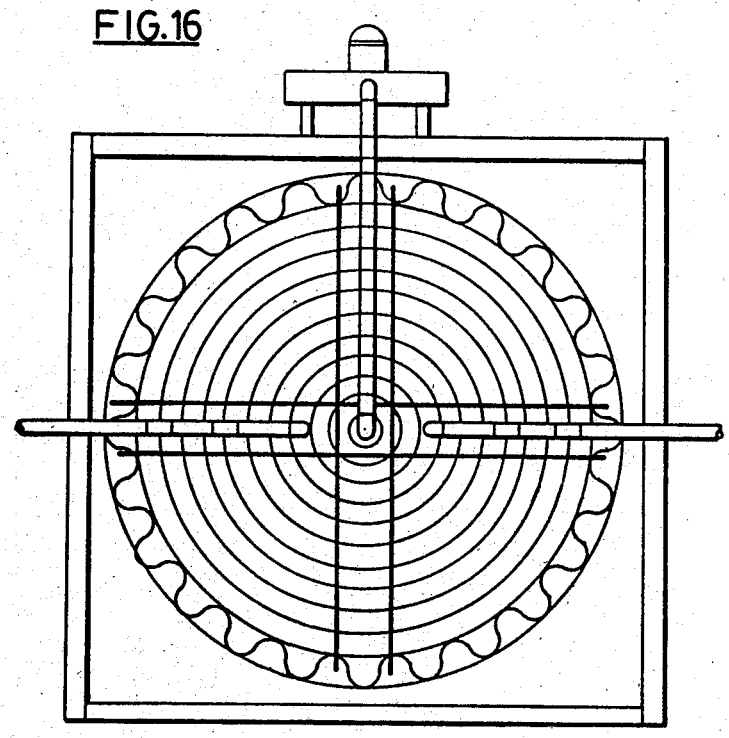
Figure 17:
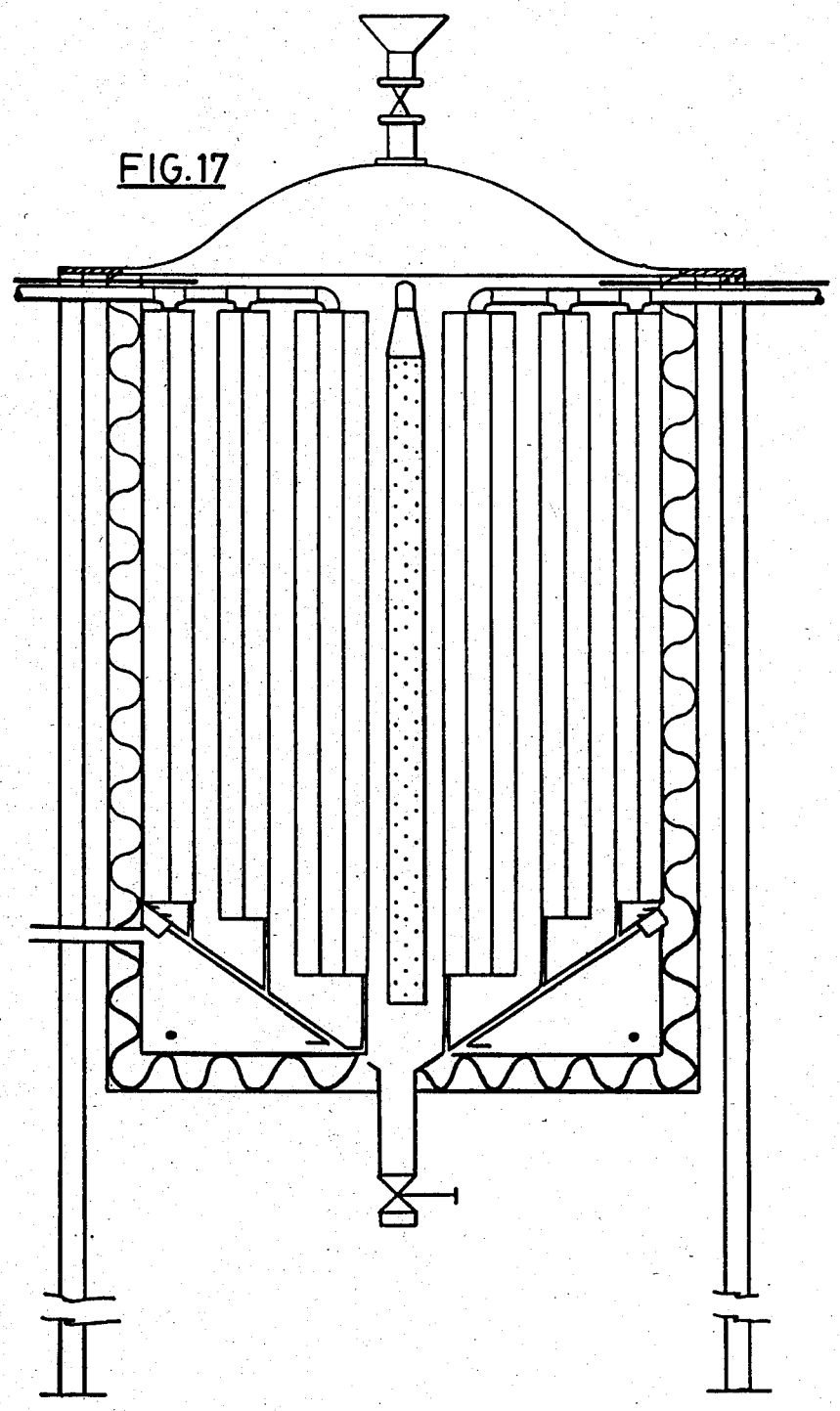
Figure 18:
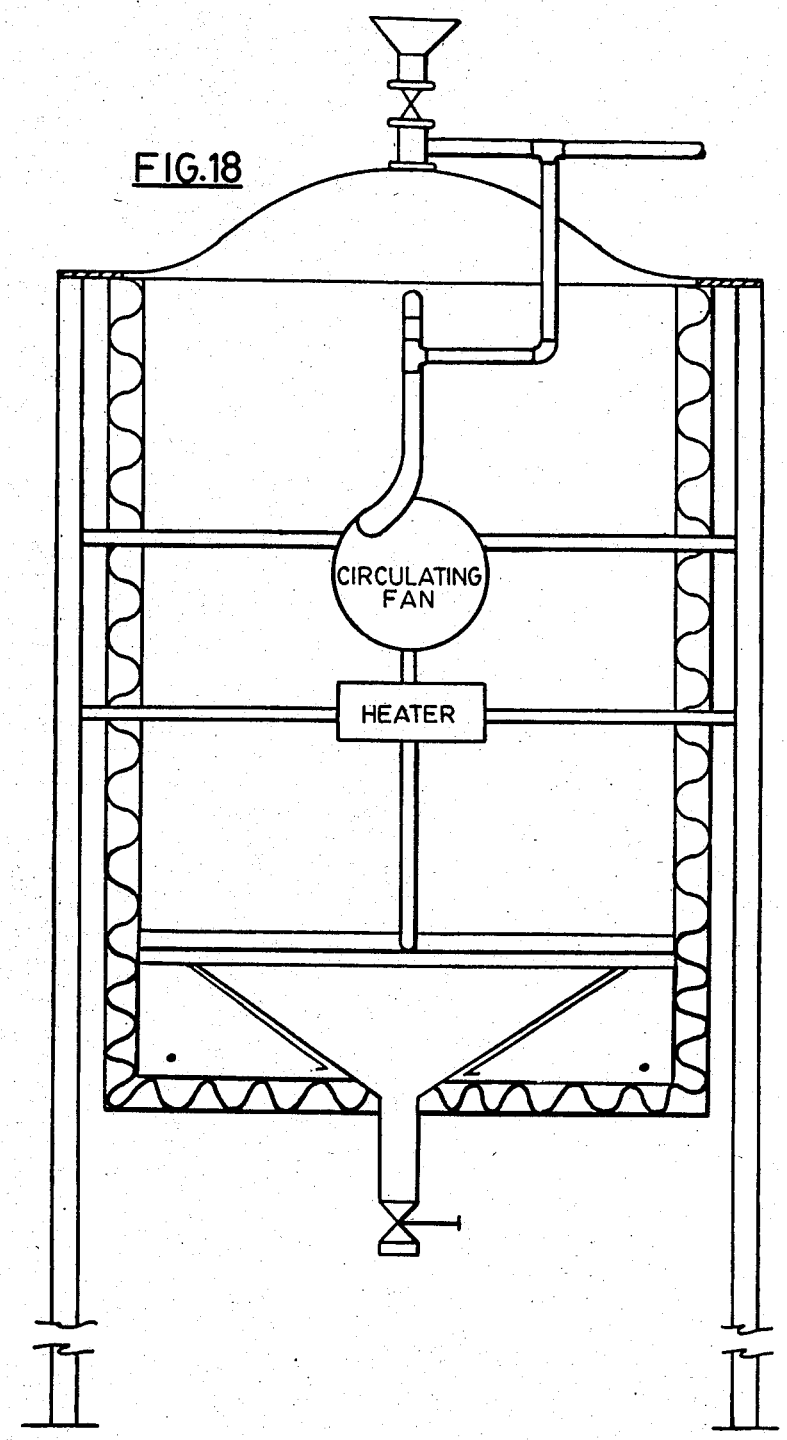

FIG. 12 shows a view of the variable volume chamber similar to FIG. 11*a,* with the chamber shown in section;

FIG. 13 shows a section through a tube, for air supply and discharge to the chamber;

FIG. 14 shows a vertical cross-section through a fourth embodiment of the variable volume chamber;

FIG. 15 shows a view, similar to that of FIG. 11, through the fourth embodiment of the variable volume chamber, in a section along line A—A of FIG. 16;

FIG. 16 shows a cross-section along the line B—B of FIG. 14;

FIG. 17 shows a vertical cross-section through a fifth embodiment of the variable volume chamber;

FIG. 18 shows a cross-section corresponding to the view of FIG. 15 through the fifth embodiment of the variable volume chamber, perpendicular to the cross-section of FIG. 17;

FIG. 19 shows one heating panel for the fourth or fifth embodiments of the variable volume chamber;

FIG. 20 shows a cross-section through parts of heating panels as shown in FIG. 19;

FIG. 21 shows the detail C of FIG. 20 on an enlarged scale;

FIG. 22 shows detail D of FIG. 19 on a enlarged scale;

FIG. 23 shows a cross section through a different form of heating channel

FIG. 24 shows a view of a variant embodiment of the panel shown in FIG. 19.

In the drawings, there are shown three different embodiments of the apparatus, and five different embodiments of a hopper or variable volume chamber. Whilst each variable volume chamber is described in relation to one apparatus, in general any variable volume chamber can be used in any apparatus. Further, many other features of the apparatus and chambers are interchangeable between the various embodiments.

Figure 1:
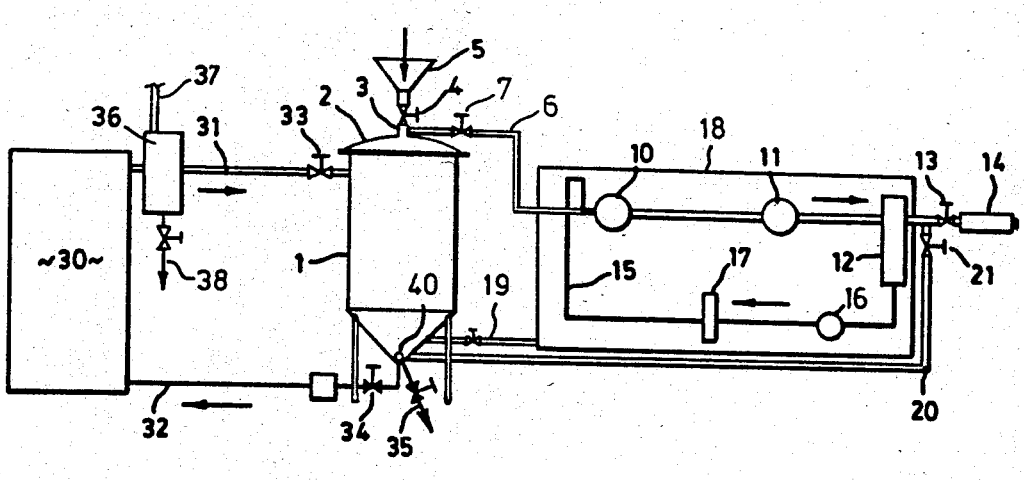
FIG. 1 shows diagramatically an apparatus according to one embodiment of the present invention.

The apparatus, shown in FIG. 1, has a variable volume chamber in the form of a hopper 1 which is closed at its top by a diaphram 2. The diaphram 2 has a central opening 3 which is connected by a valve 4 to an inlet hopper or chute 5. The central opening 3 is also connected to a flexible suction line 6, which includes a valve 7. In the line 6, there is a first vacuum pump 10 and a second vacuum pump 11 downstream of pump 10, in turn followed by an oil separator 12. Downstream from the oil separator 12, the line 6 includes a valve 13 and a muffler 14. A line 20 branches off from the line 6 downstream of the oil separator 12 and upstream of valve 13 and includes a valve 21. The oil separator 12 has an outlet for oil, which is connected by a line 15 to the line 6 upstream of the first vacuum pump 10. The line 15 for oil includes an oil pump 16 and an oil cooler 17.

A steam generator 30 is provided as one source of heat for the hopper 1 and its contents. The steam generator 30 is connected to heat exchange tubes 70 (FIG. 3*a*), explained below, within the hopper 1 by a steam line 31, including a valve 33, and a condensate return line 32. The steam line 31 optionally includes a steam superheater 36, which receives heat from external sources via line 37 and discharges exhaust and condensate by line 38. The condensate line 32 includes a valve 34. As illustrated in FIG. 3*a,* the lines 31 and 32 are connected to a first part of a jacket 48 around the hopper 1, and this jacket is also connected to a waste water line 35. The components 30, 31, 32, 36, and a part of 48 form a steam circuit.

The line 20, which branches out of the line 6, is connected to the heating jacket 48 of the hopper 1 so that heat generated by the vacuum pumps 10 and 11 and heat taken out of the hopper 1 through the pumping network can be passed back to a second part of jacket 48 of the hopper 1 to heat material therein as is explained in more detail below.

An optional heat collector 18 can be included to collect heat given off externally from the pumps 10,11, the oil separator 12 and the oil cocler 17 to provide heat to a part of heat jacket 48 of the hopper 1 by line 19.

At the bottom of the hopper 1, there is an auger 40 for driving dry grain out of the hopper 1.

Figure 2:
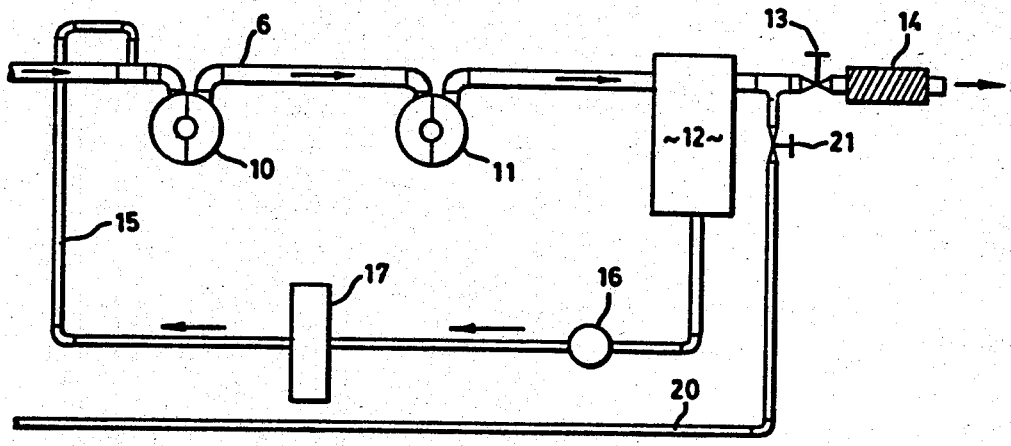
FIG. 2 shows diagramatically details of the pumping means of FIG. 1.

FIG. 2 shows the pumping components of FIG. 1 in greater detail. The vacuum pumps 10 and 11 are preferably sliding vane vacuum pumps, which each normally have the ability to generate a sub-atmospheric pressure equivalent to −26″ of mercury. The two vacuum pumps 10 and 11 are connected in series and cool oil is injected or otherwise supplied to the line 6 upstream of the pump 10, in order to increase the capacity of the pumps. By this means, the capacity of the vacuum pumps 10 and 11 can be increased from −26″ of mercury to −29″ or more.

Referring to FIGS. 3*a* and 3*b,* the hopper 1 has an outer casing 50 and an inner casing 51, which define the hollow jacket 48 for receiving heating fluids. The jacket 48 is separated into two separable portions, a first portion 48*a* which covers two opposite sides of hopper 1 and a second portion 48*b* which covers the remaining two opposite sides and the bottom of the hopper 1. Steam is supplied to jacket portion 48*a* from the line 31 and hot air and water vapor are supplied to the jacket portion 48*b* from the line 20. As indicated schematically at 52, in the jacket 48 the steam is kept separate from the air and water vapor. The air and water vapor from the line 20 is circulated around sides 53 and 54 and sloping bottom portions 55 and 56 of the hopper 1, before being exhausted to atmosphere. Ends 57 and 58 of the jacket 48 (See FIG. 3*b*) form headers for steam, and for waste steam and condensate. To conserve heat, the hopper 1 is enclosed by a layer of insulation (not shown).

Thus, the jacket 48 is split into one part, 48*b* (the sides 53 and 54 and the bottom portions 55 and 56) which is supplied with sensible heat from the line 20, and a second part 48*a*, (the ends 57 and 58) through which steam, or steam and condensate flows. The size of these two parts can be varied. In particular, the size can be varied for different intended drying rates. For example, for rapid drying, the heat supplied by line 20 will only comprise a small part of the heat supplied. The line 20 could then be connected to just one side 53 or 54, with the remainder of the jacket 48 forming part of the steam circuit. Alternatively, for slow drying or low temperature applications, where the line 20 supplies most of the heat, the entire jacket 48 can be supplied from the line 20. For rapid drying, when the temperature of the material being dried is not critical, the entire jacket 48 can be supplied with superheated steam from line 31.

As indicated in FIG. 3*b*, at ends 57 and 58, the inner casing 51 (indicated by a dotted line) forms tube sheets 59 and 60 in jacket area 48*a*. Tubes 70 of elongate cross-section are secured in the tube sheets 59 and 60. Spaces between the tube sheets 59 or 60 and respective portions of the outer casing 50 form the headers for the tubes 70. In the embodiment shown in FIG. 3*a*, the tubes 70 are disposed in five horizontal rows of fifteen tubes, and below these a row of nine tubes and a row of three tubes. The steam line 31 is connected to the header associated with the tube sheet 59, whilst the condensate return line 32 is connected to the header associated with the other tube sheet 60.

The auger 40 located at the bottom of the hopper 1 is provided with a shield 42 as shown in FIG. 3*a*. The auger 40 extends the full length of the hopper 1.

In use of the apparatus, the hopper 1 is filled with grain. A vibrator (not shown) can be used to ensure that the grain is as compacted as possible, and that there are no voids in the hopper 1. Also the hopper 1 should be filled as full as possible, since the grain tends to shrink during drying. The valve 4 is then closed. The grain is dried by steam supplied from the steam generator 30 and also by hot air and water vapor supplied through the lines 19 and 20. Simultaneously the vacuum pumps 10 and 11 are operated to evacuate the interior of the hopper 1.

Since the upper closure of the hopper 1 is the flexible diaphram 2, no pressure differential can occur across the walls of the hopper 1, even though a sub-atmospheric pressure is present. In effect, as the pressure is reduced in the hopper 1, the atmospheric pressure acting on the sides of the hopper is transmitted through the grain, which serves to support the sides of the hopper 1. Thus, the hopper 1 does not have to be capable of withstanding a substantial pressure differential.

The presence of a sub-atmospheric pressure in the hopper 1 serves to limit the temperature of the moist grain, even if high steam temperatures, such as 200°-225° C. are used. The required temperature of the grain is determined by the boiling temperature of water at the pressure obtaining in the hopper 1 at any one time. Any attempt to heat the grain above this temperature merely causes additional water vapor to be driven off from the grain.

Heating of the grain and the maintenance of the subatmoshperic pressure of partial vacuum are maintained, until the grain has been dried sufficiently. For example, grain with an initial 30% moisture content can be dried until it has a 15% moisture content. The grain can then be removed from the hopper 1, by means of the auger 40. Again, a vibrator can be used to ensure that no blockages occur within the hopper 1.

If the product being dried is subject to damage at high temperatures, the steam generator can be operated at sub-atmospheric pressures with steam temperatures as low as 40° C.

FIG. 4 shows an alterative construction of the hopper 1. In this second embodiment, the flexible diaphragm 2 is replaced by a rigid cover 80. The cover 80 is suspended by means of springs or hydraulic actuating units 81 from a supporting frame 82. The cover 80 is connected to the main body of the hopper 1 by a bellows 83. A sleeve 84 is secured to the cover 80 and is capable of sliding inside the inner casing 51. The bellows 83 serves the same function as the diaphram 2 in the first embodiment, in that it enables a sub-atmospheric pressure to be created in a loaded hopper 1, without any pressure differential being created across the walls of the hopper 1. The sleeve 84 serves to keep grain out of the convolutions of the bellows 83.

FIGS. 5 and 6 show two further different views of this second embodiment.

In use, operation is similiar to that for the first embodiment. The hopper 1 is fully loaded via the valve 4 and inlet hopper 5, and the valve 4 is then closed. The hopper 1 is then heated and the pumps 10 and 11 are operated to create a partial vacuum inside the hopper 1. Under the influence of the sub-atmoshperic pressure and due to shrinkage caused by drying the cover 80 will slowly descend to ensure that no pressure differential is created across the cover 80 or the side walls of the hopper 1.

Whilst the two embodiments shown include steam heating for the hopper 1 and heating by means of the exhaust from the vacuum pumps, other methods of heating are possible. For example, the tubes 70 could be replaced by similarly shaped electrical heating elements. It is expected that such an arrangement would be suitable for a small installation, that would not justify the complexity or expenditure required for a separate steam generator. Also, it is possible to arrange for the pumps 10 and 11 to be driven by the power take off shaft of a tractor, and in this case waste heat from the tractor can also be utilized to heat the hopper 1.

In addition, as shown in FIG. 1, a heat collector 18 can be provided which collects heat from the pumping components and supplies heated air to the hopper 1, via line 19.

The rate at which the grain is dried can be varied to suit local conditions and the required use of the grain. The grain can be dried in only a few hours, if a high throughput grain is required. In this case, the rate of heat supply to the hopper 1 would have to be relatively large. Alternatively, the hopper 1 can be filled and left to run for a relatively long period of time, for example 12 or more hours. Such a mode of operation might be desirable on a small farm, where the hopper could be loaded and left to run overnight, in which case recycled heat could comprise the primary, if not the sole, heat input. Also, the ultimate use of the grain may determine the mode of operation. For feed corn, one does not need to be particularly careful. However, for corn oil and seed corn greater care is required. For corn oil, stress cracking should be eliminated or minimized, whilst for seed corn there should be no stress cracking and the germination properties of the corn should not be affected by the drying. To avoid stress cracking, it is necessary that the grain is heated relatively slowly; any sharp temperature increases are likely to cause cracking. For seed or malting grain, it is necessary to keep the temperature below a maximum of 60° C. for wheat and 45° C. for other grains, in order not to effect the germination properties. For grain for feed use, the maximum temperature is 80° C., whilst for grain for other commercial uses the maximum temperature is in the range 45°–70° C., dependant on the particular grain. In this respect, the use of a maximum obtainable vacuum in the hopper and sub-atmospheric pressure in the steam generator helps, since the maximum temperature of the corn is limited by the boiling temperature of water at the pressure obtained in the hopper. The low temperature steam from the sub-atmospheric pressure condition in the steam generator provides further assurance of not causing damage to the seed germination properties.

Heat exchange tubes of various designs could be used. FIG. 7 shows, on an enlarged scale a cross-section through one tube 70, a preferred embodiment of a tube for use in the present invention. At the top, there are two flat angled portions 71, each of which is at an angle of 45° to the vertical. The angle of these portions 71 is determined by the angle of repose of the material intended to be dried by the hopper. The two portions 71 are joined together by a rounded ridge 72. At shoulders 73, the portions 71 join sides 74 of the tube 70. The sides 74 taper inwardly in a downward direction. At the bottom, a rounded bottom 75 extends between the two sides 74.

The two portions 71 are inclined at an angle to the horizontal greater than any angle of repose for material intended to be used in the hopper. By this means, no such material, either wet or dry, should adhere or rest on these portions 71. The sides 74 are tapered inwards, with a view to preventing material forming bridges or otherwise becoming blocked between adjacent tubes 70. The widest portion of each tube 70 occurs at the shoulders 73, and consequently the narrowest gap between adjacent tubes 70 will be at the level of the shoulders 73. The portions 71 are so inclined that all material should slide down them towards the gap between adjacents shoulders 73, and once through the gap that material falls through a continuous widening gap until it clears that row of tubes. Consequently, it is expected that there should be little danger of blockage between the tubes 70. The bottom 75 is rounded so as to form a channel in which condensate can collect.

In the described embodiments, the tubes were formed from sheet material having a initial width of 2′, so that the total circumference of each tube is approximately 2′. The height of each tube is 11.073″ and at the shoulders 73 it is $\frac{7}{8}$″ wide. The ridge 72 at the top has a radius of 1/16″ and the distance between the sides 74 where they join the bottom 75 is $\frac{5}{8}$″. The material has a wall thickness of 0.062″.

The tubes 70 have been primarily shaped to maximize heat transfer to material within the hopper 1, and assist in flow of material around the tubes 70. If necessary, in order to increase the structural strength of the tubes 70, stay bolts 76 can be provided. Similiarly, stay bolts can be provided between the inner and outer casings 50 and 51 of the hopper 1, if desired. For example, if steam is to be supplied to the hopper 1 at any great pressure then it may be necessary to reinforce the inner and outer casings 50 and 51 with stay bolts.

It will be appreciated from the foregoing that the invention can take many forms consistent with utilizing a variable volume pressure chamber to control the temperature at which material, such as grain, is dried. For example with some materials, such as lumber, a bag-like chamber can be utilized with heat applied solely to the bag exterior. In such an application, if low drying times are desirable or not undesirable, solar heat could be utilized.

In other materials chemical, biological or biochemcial reactions may provide sufficient heat to eliminate the need for external heat sources. For example hay could be dried in a variable volume chamber or a bag-like chamber using the heat generated within the hay by biological and biochemical reactions.

Reference will now be made to FIGS. 8, 9, 11*a*, 11*b* and 12, which show the second embodiment of the invention and another embodiment of the variable volume chamber or hopper. In these Figures, parts which are the same as those shown in FIGS. 1–7 are given the same reference numeral, and description of these parts will not be repeated.

Referring first to FIG. 8, the hopper 1 is provided with an input material auger 100, for supplying grain or other material to the chute 5.

The previous embodiment of the invention included two vacuum pumps 10, 11 for maintaining the vacuum in the hopper 1. For a hopper 1 with a capacity of 400 bushels, these pumps 10, 11 would require a power in the magnitude of 25–30 hp. In use once a sub-atmospheric pressure has been established in the hopper 1, the pumps 10, 11 are primarily pumping a relatively large quantity of water vapor. It has been realized that, the pump capacity can be reduced, if this water vapor is condensed upstream of the pumps 10, 11. For this purpose, a condenser circuit indicated at 102 is provided. The condenser circuit 102 includes a condenser 104. The condenser 104 is connected by an inlet line 106 including a control valve 108 to the hopper 1. An outlet of the condenser 104 is connected to a water/vapor seperator 110. This separator 110 has an outlet line 114 for water, including a valve, and a vapor line 112 connected to the line 6, upstream of the pumps 10, 11. To cool the condenser 104, an inlet 116, and outlet 118 are provided for cold water. In use, gas and vapor can be drawn off from the hopper 1 by the pumps 10, 11, through the condenser 104. Water vapor is condensed and taken off through the line 114, so that flowing to the pumps 10, 11 through the line 11, is only the gaseous components. This enables the capacity of the pumps 10, 11 to be reduced. In practice, it has been found that the capacity of the pumps can be reduced from 25–30 hp to 3–5 hp. However, if the condenser should be air-cooled, this will be offset by the need to provide a fan for the condenser. Surprisingly, it has been found in practice that gas and vapor cannot be drawn off from the hopper 1 solely through the condenser circuit 102, with the valve 7 closed. It appears that some volatile type of materials accumulate at the top of the hopper 1. After a period of time, they effectively block flow through the condenser circuit 102. To overcome this problem, it has been found necessary to have the valve 7 opened slightly, so that a small portion of the gas and vapor in the hopper 1 pass directly to the pumps 10, 11. The major part of the gas and vapor from the hopper 1 would still pass through the condenser circuit 102. It may also be necessary to provide other by-pass lines to high spots in the system where non-condensable materials collect.

The pumping arrangement, provided by the components 11–17 is the same as before. However, in view of the lower power of the pumps, the effective heat output of the pumping circuit is not expected to be that useful for drying purposes. Consequently, the line 20, which connected the output of the pump to the hopper 1 is not present. Similarly, the heat collector 18 is not provided. FIG. 9 shows the details of the pumping arrangement for this embodiment of this invention.

Turning to FIG. 10, which shows a third embodiment of the apparatus, again there is provided a condenser circuit, here indicated by the reference 120. The condenser is an air cooled condenser 122, for which a fan 124 is provided. Otherwise, the condenser 122 is connected as in FIG. 8 to the line 6. The air outlet side of the condenser 122 is connected by a duct 126 to an input conveyor 130. The input conveyer 130 has a housing, and within the housing a conveyor 132 for incoming grain or other material. The conveyor belt 132 feeds the grain or other material to an auger 134, which in turn feeds the grain to the chute 5. The housing of the conveyor 130 has an outlet, so that hot air from the condenser 122 flows through the grain on the conveyor belt 132, and then out of the housing, as indicated by the arrow 136. It has been found that, to provide adequate cooling, the fan 124 needs to be approximately 25 hp. Whilst this horsepower is equivalent to the pumping power in the first embodiment of the apparatus, the heat from the condenser 122 is recovered by the incoming grain.

Consequently, the grain is partially dried and preheated. Again, FIG. 9 shows the pumping arrangement for this embodiment of the apparatus.

FIGS. 11*a*, 11*b* and 12 show a third embodiment of the hopper, designated by the reference 140. This embodiment of the hopper 140 is shown with the diaphram 2, of FIGS. 3*a* and 3*b*. However, it should be realized that it could be provided with the variable volume features of FIGS. 4, 5 and 6 instead.

The hopper 140 is generally constructed as in the other two embodiments. However, it includes tubes 142, which are shown in FIGS. 11*a* by thick lines, but which can be similar to the tubes 70, as shown in FIG. 13. These tubes 142 are not connected into the steam circuit, but instead form part of an air circuit 144. The two lower tubes 142 are connected to an inlet of a heater 146, as shown in FIG. 12. The heater 146 is in turn connected to an enclosed fan 148. As shown in FIG. 13, the tubes 142 include openings 154, for passage of air, which are distributed along the bottom of each tube. An outlet of the fan 148 is connected to the top three tubes 142, by pipes 150.

The purpose of this air circuit 144 is to improve heating of the grain within the hopper 140. It has been found that it is quite difficult to heat grain within the hopper, when a very low pressure, e.g. pressure corresponding to −29″ of mercury relative to atmospheric pressure, obtains in the hopper. As there is very little gas or vapor in the hopper 140, then heat transfer occurs almost solely by conduction. However, the individual grains only make point contact with one another, and transfer by heat conduction is thus very inefficient. It has been found that grain very close to the heat source i.e. pipes 70, can be overheated, whilst grain nearby is not heated sufficiently. Additionally, it has been found that large temperature gradients can occur near the outlet from the hopper, where air and vapor are drawn off.

With the air circuit 144, it is now possible to operate the apparatus, so that heating is assisted by air. This is achieved as follows. Initially, the grain is heated, with the interior of the hopper 140 at atmospheric pressure. Then, gas and vapor are drawn off from the hopper 140, and the resultant vacuum or sub-atmospheric pressure is maintained for a certain period of time, until the amount of moisture being drawn off drops sufficiently. This occurs, because a large part of the grain has now cooled, and cannot adequately be heated. Then, the vacuum can be released, by letting air back into the hopper. Air is released into the hopper 140 through the openings 154. This air is then continuously drawn off through the two lower most tubes 142, and circulated by the fan 148. The air is returned to the top of the hopper through the three top tubes 142. This is carried on until the grain has reached a desired temperature again. Typically, this might be 100° F., although it could be up to 180° F. Then, the vacuum or sub-atmospheric pressure is put onto the hopper 140 again, by the pumps 10, 11. It is again maintained, until vapor output drops; this typically takes ½–1 hour. Then, if required, the cycle of readmitting air, and then recreating the vacuum can be repeated. It can be repeated as many times as desired, until a desired grain dryness is achieved. It has been found that this can considerably shorten drying time. In order to reduce the time necessary to draw down or create the vacuum, a vacuum vessel can be provided, connected to the pumps 10, 11. Then, whilst the grain is being heated by circulated air, the pumps 10, 11 can evacuate this vessel. It is then connected to the hopper 140, when it is desired to draw down the vacuum or sub-atmospheric pressure again. While air is circulated around the grain, heat can be supplied by one or both of the heater 146 and the steam source 30.

By using the fan 148, air stratification within the hopper 140 should be eliminated. Depending on the size, etc., of the hopper 140, the tubes 142 can be positioned to ensure adequate air flow over the entire contents of the hopper. It is also possible that some other fluid, particularly another gas, could be used in place of air to improve heat transfer. Ideally, this will be a gas with good heat transfer characterstics, and means should be provided for recovering the gas. An alternative to air or gas is to use superheated steam. The steam should be sufficiently superheated, to prevent condensation on the grain. For this purpose, the steam can be circulated at a sub-atmospheric pressure.

FIG. 13 shows a detail of one of the tubes 142. It is generally similar to the tubes 70, and again like parts are given the same reference numerals. At the top of each tube 142, there is, at one end, an opening 152, which is connected to the pipe work outside the hopper 140. As previously mentioned, at the bottom of each tube 142, there is a series of openings 154, to permit air to be withdrawn into the tubes 142, or passed from the tubes 142. When it is desired to admit air to the hopper 140, this can be achieved either through these openings 154, or though the opening at the top of the hopper 14.

Reference will now be made to FIGS. 14, 15 and 16, in conjunction with FIGS. 19–23. These figures show another embodiment of the hopper, which includes heating panels formed from sheet aluminum, with ducts traversing the sheets for the steam or other fluid. This type of construction has the advantage of providing a large heat transfer area, even though the ducts themselves only have a small surface area. Such a construction is advantageously formed by securing two sheets of aluminum together, with the ducts defined between them. A preferred construction for this purpose is an Alcan product, manufactured under the name Roll-Bond. Details of this type of construction of the panel are given below, in relation to FIGS. 19, 20, 21, 22 and 23. However, it is to be appreciated that any suitable form of heating panel can be used, which is compatible with the material, such as grain, dried in the apparatus. Thus, for example, it is possible that a heating panel could be formed by a suitably formed length of tube or pipe, which is brazed, welded or otherwise secured to a sheet of metal.

In the fourth embodiment of the hopper shown in FIGS. 14, 15 and 16, as before, like parts are given the same reference numerals as in earlier figures. Here, the hopper is denoted by the reference 180, and insulation between the inner and outer casings 50, 51 is denoted by the reference 182. A support frame for the hopper is denoted by the reference 184. Unlike earlier embodiments of the hopper, instead of an auger 40 for discharging grain, a bottom of the hopper 180 is formed as an inverted cone, and is provided with a vertical discharge pipe 186, including a control valve or gate 188.

Within the hopper 180, cylindrical heating elements 190 are provided, these heating elements 190 being shown diagramatically in FIG. 14. As the plate form of the heating elements 190 can possibly not be sufficiently strong, in relation to the type of loads imposed by grain, the heating elements 190 are formed as cylinders, which are arranged with their axes vertical. The cylindrical heating elements 190 are located inside one another. Then, the grain simply has to pass vertically down between the heating elements 190, so that no excessive loads should be applied to the heating elements or panels 190. Also, as the hopper 180 is loaded or unloaded, each portion of the heating elements 190 should, generally, be subjected to balanced loads by grain on either side; it should never be subjected to a large load due to grain on one side of the panel, and no grain on the other side of the panel.

In the embodiment shown in FIGS. 14, 15 and 16, there are ten individual heating elements or panels 190, which are denoted by the references 191 through 200. At the outside of the hopper 180, immediately adjacent the inner casing 51, there is the largest diameter heating element 191. It is provided against the inner casing 51, to ensure that no cold spots occur around the outside of the hopper 180. The next two heating elements 192, 193 have the same axial length as the first heating element 191. These elements 191, 192, 193 form a first group of heating elements, which are connected together to inlet pipes 202, for steam, as indicated at 204. The next three heating elements 194, 195, 196, form a second group of heating elements, which are slightly longer than the first group of heating elements, and again are connected together to the steam pipes 202, as indicated at 206. The inner four heating elements 197–200 form a third group of heating elements, which are similarly connected to the steam pipes 202, as indicated at 208. This third group of heating elements 197–200 again is longer than both the two preceding groups of heating elements.

At the bottom of each group of heating elements, provision is made to collect condensate formed in the heating elements, as a result of heat transfer from the steam to grain around the heating elements. For this purpose, condensate collection pipes 210 are provided immediately inside the conical bottom portion of the hopper 180, which is indicated at 212. The first group of heating elements 191, 192 and 193 are connected to the condensate collection pipes 210 by short connection pipes 214. Similarly, connection pipes 216 are connected to the second group of heating elements 194, 195 and 196, and to the condensate collection pipes 210. The inner group of heating elements 197–200 are connected by collection pipes 218 to the condensate collection pipes 210. Instead of discrete collection pipes 210, the conical bottom portion 212 of the hopper 180 can be formed with a double-skin interior surface, which then defines a narrow conical collecting chamber, to which the connection pipes can be connected. As indicated at 220, the condensate collection pipes 210 are connected to an outlet pipe. The outlet pipe 220, and the steam pipes 202 would be connected to a steam generator or source, such as the steam generator 30 of FIG. 1.

Reference will now be made to FIGS. 19, 20 and 21, which show details of the panels forming the heating elements 190. FIG. 19 shows one individual heating panel, 222. This panel has a width 224, which is 26.3". Its length indicated at 226 is variable, as shown in FIG. 14. In the panel 222, there are 17 vertical channels 228, which are connected together by top and bottom horizontal channels 230, which serve as headers. An inlet or supply duct 232 is provided at the top right-hand corner, whilst an outlet or return duct 234 is provided at the bottom left-hand corner: Each of the ducts or channels 228 is ½" in diameter, and they are located at 1½" centres. The inlet 232, as indicated at 236, is spaced 1½" from the edge of the panel 222. FIG. 20 shows a horizontal cross-section through one panel of 222, and the extreme edge of an adjacent panel, denoted by the reference 238. As shown, each panel 222 is formed from two sheets 240, and each sheet 240 has indentations 242 of semi-circular cross-section formed in it. Each pair of semi-circular indentations 242 forms one of the channels 228, 230. As shown in the enlarged view of FIG. 21, the panel 222 is joined to the edge portion 238 of the adjacent panel, by means of rivets 244, or other suitable fasteners. For example, bolts could be used, or the panels could be welded together.

The number of panels 222 required to make each individual heating element 190, depends upon the size of the heating element. The heating elements 190 are so dimensioned, that an integral number of panels 222 are required for each element. Thus, for example, the outer most heating element 191 could be formed from eleven panels 222, the next heating element 192 is formed from ten panels 222, the next heating 193 is formed from nine panels 222, and so on. This also provides a uniform spacing between adjacent heating elements 190. The inlets 232 of the panels 190 are all connected to the steam pipes 202. Similarly, all the outlet ducts 234 of the panels 190 are provided with connection pipes 214, 216, 218.

Referring back to FIG. 15, there is shown a partial cross-section through the hopper 180 of FIG. 14. Here, like the previous embodiment of the hopper, an air circuit 144 is provided. This air circuit 144 includes the heater 146, a circulation fan 148, and a distribution pipe 150. Here, as described in detail below, the distribution pipe 150 is connected to just one pipe passing into the hopper itself. Flexible vacuum pipes 250 are connected to both the pipe 150 and a short duct section between the valve 4 and diaphragm 2. Although not shown, the vacuum pipes 250 would be connected to pumps, such as pumps 10, 11 in FIG. 1. As shown most clearly in FIG. 14, the pipe 150 is connected to a large diameter perforated tube 252, located axially within the hopper 180. The tube 252 extends almost the full vertical height of the hopper 180, and includes perforations, which are smaller than the smallest expected size of the grain or other materials to be dried, so that grain or other material cannot enter the tube 252. The lower end of the tube 252 is closed off. This enables a vacuum or sub-atmospheric pressure, to be established in the hopper 180, by drawing air both through the opening in the top of the diaphragm 2, and through the tube 252. This should enable air to be withdrawn readily, to quickly establish a sub-atmospheric pressure. As shown in FIG. 15, the heating device 146 and the fan 148 are supported on cross members or bracket 254, extending between members of the support frame 184. Extending adjacent the lower edge of the cylindrical portion of the hopper 180 is an air duct, denoted by the reference 256. This air duct 256 is connected by a pipe 258 to the inlet of the heater 146 as indicated schematically in FIG. 14, the air duct 256 is provided with outlets opening into the interior of the hopper 180. These outlets are provided with slats and/or other devices, to permit air to flow out of the duct 256, whilst preventing grain or other relevant material entering the duct 256. In use, when it is desired to heat the contents of the hopper 180, as described for the previous embodiment of the hopper, air is withdrawn from the hopper through duct 256, heated by the heating means 146, and then delivered by the circulation fan 148 to the tube 242. From the tube 252, it flows evenly around the contents of the hopper, to heat them, to the air duct 256. With reference to FIG. 16, the heating elements 190 are supported by hangers or brackets 248, which extend diametrically across the top of the hopper 180.

Reference will now be made to FIGS. 17 and 18, which show details of a fifth embodiment of the hopper, denoted by the reference 260. This fifth embodiment of the hopper 260 is generally similar to the fourth embodiment 180 just described, and again like parts are given the same reference numerals. In this respect, the description of the fourth embodiment of the hopper 180 is equally applicable to this fifth embodiment 260.

The hopper 260 varies, in that the steam source is provided within the hopper itself. As shown at the bottom of the hopper 260, the inner and outer casings, 50, 51, instead of following the conical bottom surface of the actual hopper interior, extend straight downwards, and are continuous with corresponding planar bottom casing portions 262, 264. Here, to collect the condensate from the connection pipes 214, 216, 218, a conical collection chamber 210 is provided. The lower end of this chamber 210 opens directly into a heating chamber 266, instead of being connected to a condensate outlet pipe 220. The heating chamber 266 is generally annular, and is defined between the conical condensate collecting chamber 210 and the inner casing adjacent the insulation. The chamber 266 is provided with a steam outlet pipe 268. This steam outlet pipe 268 is connected to the steam pipes 202, although this is not shown in FIG. 17. Additionally, a heating element which is shown schematically at 270, is provided within the chamber 266. This heating element 270 is preferably an electrical heating element. Thus, in this embodiment, condensate passes directly from the elements 190 into the heating chamber 266, without leaving the hopper 260. Here, it is reheated, and the resultant steam is passed to the steam pipes 202, for another passage through the heating elements 190.

This arrangement has the advantage that no separate steam heating unit is required. By providing the steam generating unit within the hopper 260, heat losses should be reduced, thereby saving on energy costs. It is expected to be particularly suitable for small installations, where a high throughput is not required.

Although a steam outlet 268 is shown passing out through the insulation 182, the connection between the heating chamber 266 and the distribution pipes at the top of the heating elements 190 could be effected entirely within the insulation 182 of hopper 260. This would further reduce heat losses to the exterior. Further, although the condensate collection chamber is shown adjacent the heating chamber 266, this could prove disadvantageous under certain operating conditions. It is possible that heat from the chamber 266 could cause premature steam generation in the condensate collection chamber, which might cause the flow of condensate to reverse. This could be eliminated, by providing a thin layer of insulation between the condensate collection chamber and the steam heating chamber 266.

With reference to FIG. 23, there is shown a crosssection through a variant of the heating panel. In FIG. 20, each sheet 240 is provided with corresponding semi-circular section indentations 242 (although in FIG. 20 the wall thickness of the indentations 242 is shown less than that for the main body of each panel 240, in practice the wall thickness is normally uniform across the width of the heat 240). In FIG. 23, there is shown is shown a cross-section through the panel 280, which is formed from two sheets 282, 284. These sheets 282, 284 can be of the same thickness, or as shown of slightly different thicknesses. Here, the sheet 284 is left flat, and the channel sections are formed in the top sheet 282. FIG. 23 also shows the connection of an inlet tube 286. This tube 286 is brazed or welded in position, and the spaces indicated at 288 would be filled with weld or brazed material. A heating panel can include channel sections both as shown in FIG. 20 and FIG. 23, simultaneously. It is preferable that this type of heating panel is formed preferably by an Alcan product manufactured under the name Roll-Bond. However, other types of construction are possible, such as conventional brazing or welding of sheets together, to form the desired channel pattern.

With reference to FIG. 24, there is shown a heating panel 290, adapted for use with an electrical heating element. This type of panel 290 would be formed into cylinders, as described above. Here, the panel 290 is simply provided with a number of vertical channels 292, each of which extends the full height of the panel 290, the dimensions of the panel 290 being similar to those described above. Thus, each channel 292 is open at its top and bottom ends. This enables a long heating wire or element, designated by the reference 294, to be threaded through the channels 292. The ends of this heating element or wire are marked at 296. As indicated at 298, semi-circular loops are formed in the heating element 294, as it passes from one channel 292 to the adjacent channel 292. In this way, the element 294 can be threaded through all the channels 292. After insertion of the element 294, if desired, a protective cap can be provided at the top and the bottom, to cover the loops 298. An electrically heated hopper is expected to be particularly suited for small installations, where the expense and complexity of steam heating are not justified.

The profiles of the channels 228, 230, 292 in the heating panels should be adapted, to facilitate passage of grain, or other relevant material between the individual heating elements 190. To this end, for the horizontal channels 230, a flattened profile can be provided, so that no steep shelves or ledges are formed, which might hinder grain flow. In this respect, the panel 290 of FIG. 24 is preferable, as there are no horizontal channels. Additionally, although each heating panel 222, 290 is shown as a solid panel, it can be provided with openings, which can be so sized as to permit a small amount of grain passage through the panel, without significantly reducing heat transfer. This should prevent any undue stresses being applied to the heating elements 190. Further, the inlet chute 5 opens directly into the centre of the hopper. This would cause the innermost heating element 200 to be filled with grain first. This could be acceptable in some designs. Alternatively, if one wishes to ensure that grain is uniformly distributed between the heating elements 190, some type of distributor can be provided at the top of the hopper below the chute 5.

When using the technique of alternately creating a vacuum or sub-atmospheric pressure in the hopper, and then readmitting air, it is possible that one pumping apparatus can be provided for two or more hoppers. In many cases, this will be preferable. Then, whilst one or more hoppers are being heated by circulated air, the pumping apparatus can be withdrawing air and moisture from another hopper. This makes maximum use of the pumping apparatus. Further, the hoppers can be arranged, so that each hopper dries the grain to a certain dryness level. Thus, for example, the first hopper could dry the grain to a moisture content of 30%. The grain is then transferred to the second hopper. In this second hopper, the moisture is reduced further to 20%, before being transferred to the third hopper. In the third hopper, the moisture content is reduced further to 15%. This process can be repeated for any number of hoppers. If grain is available that initially has a moisture content of 20%, then typically it will be delivered straight to the second hopper. This enables a controlled continuous drying process to be provided.

In an alternative construction (not shown), the variable volume chamber could have a top enclosure portion having a top wall and side and end walls. A bottom enclosure portion also has side and end walls together with a bottom wall. The side and end walls of the top and bottom enclosure portions telescopically engage one another in a pressure-tight manner, to enable the volume of the chamber to be varied.

We claim:

1. An apparatus for reducing the moisture content of a material, the apparatus comprising:

a variable volume chamber adapted to receive such material, in which chamber the moisture content of the material is reduced and which chamber is at least partially defined by rigid walls;

heating means within the chamber arranged to heat the material by direct contact with the material; and pumping means connected to the chamber for pumping fluid from the chamber and capable of maintaining a sub-atmospheric pressure equivalent to at least 16 inches of mercury below atmospheric pressure in the chamber sufficient to substantially reduce (the) heat input from the heating means required to heat material within the chamber;

the arrangement being such that, in use, the chamber is filled with material, the pumping means pumps fluid from the chamber to create a sub-atmospheric pressure therein, the variable volume chamber reduces in volume so that external pressure is transmitted to the material within the chamber and no substantial pressure load is carried by the walls of the chamber, and material within the chamber is heated by the heating means to cause vaporization of moisture in the material at a temperature below the boiling point of water at atmospheric pressure, the vaporized moisture being drawn off by the pumping means.

2. An apparatus as claimed in claim 1, wherein the heating means is capable of heating material within the chamber to a temperature within the range 25°–80° C.

3. An apparatus as claimed in claim 2, wherein the pumping means is capable of producing a sub-atmospheric pressure such that the temperature attained by material within the chamber is the same as or higher than its boiling temperature at that pressure.

4. An apparatus as claimed in claim 1, wherein the chamber comprises rigid side, end and bottom walls secured directly to one another, a rigid top wall and an annularly disposed expansion member connecting the top wall to the side and end walls, the expansion member enabling movement of the top wall relative to the other walls to vary the volume of the chamber.

5. An apparatus as claimed in claim 4, in which the expansion member comprises bellows.

6. An apparatus as claimed in claim 5, in which the bellows are formed of flexible sheet material and include one or more folds.

7. An apparatus as claimed in claim 4, 5, or 6 which includes one or more actuating members for displacing the top wall to enable the volume of the chamber to be increased, to facilitate filling of the chamber with a full load of material and to enable the volume of the chamber to be decreased during operation.

8. An apparatus as claimed in claim 4, wherein the expansion member comprises first parts pivotally attached to the top wall and second parts pivotally attached to the side and end walls and to the first part.

9. An apparatus as claimed in claim 5, 6, or 8, wherein, the top wall includes a downwardly depending sleeve, which slidably engages the side and end walls, to prevent material coming into direct contact with the expansion member.

10. An apparatus as claimed in claim 1, wherein, the variable volume chamber comprises a top enclosure portion having a top wall and side and end walls, and a bottom enclosure portion having a bottom wall and side and end walls, with the side and end walls of the top enclosure portion telescopically engaging the side and end walls of the bottom enclosure portion, in a pressure tight relationship therewith, to enable the volume of the chamber to be varied.

11. An apparatus as claimed in claim 1, wherein the pumping means includes an outlet which is connected to the variable volume chamber and the heating means includes at least partial recovery and recycling of thermal energy in fluid exhausted from the pumping means.

12. An apparatus as claimed in claim 1, wherein the pumping means comprises a suction line connected to the variable volume chamber and first and second vacuum pumps disposed in the suction line, with the second vacuum pump being disposed downstream of the first vacuum pump.

13. An apparatus as claimed in claim 12, wherein the vacuum pumps are lubricated with oil and the pumping means includes an oil separator disposed in the suction line downstream of the second vacuum pump for separating oil from other fluid in the suction line, an oil supply line running from the oil separator to the suction line upstream of the first vacuum pump, and an oil pump and an oil cooler disposed in the oil supply line.

14. An apparatus as claimed in claim 11, wherein, the walls of the chamber are formed by inner and outer casings which define a jacket, and wherein the outlet of the pumping means is connected to the jacket.

15. An apparatus as claimed in claim 14, wherein the heating means includes a steam generator, which is connected to a first portion of the jacket by a steam line and a condensate return line, and wherein the jacket is divided into the first portion through which steam flows and a second portion to which fluid from the pumping means flows.

16. An apparatus as claimed in claim 15, wherein the heating means includes heating tubes which are located within the variable volume chamber and which are connected to the first portion of the jacket and through which steam can flow.

17. An apparatus as claimed in claim 16, wherein the first portion of the jacket comprises end walls of the chamber and the heating tubes extend between the end walls, and wherein the second portion of the jacket comprises side and bottom walls of the chamber.

18. An apparatus as claimed in claim 17, wherein each heating tube has an elongate cross-section.

19. An apparatus as claimed in claim 18, wherein the cross-section of each tube comprises two flat top portions, which slope downwards from a ridge between them, two flat side portions which extend downwards from the top portions and which taper inwards in the downward direction, and a rounded bottom portion.

20. An apparatus as claimed in claim 19, wherein the tubes and/or the inner and outer casings are reinforced with stay bolts.

21. An apparatus as claimed in claim 11, wherein the walls of the chamber are formed by inner and outer casings which define a jacket, and the heating means comprises a steam generator connected by a steam line to the jacket.

22. An apparatus as claimed in claim 1, 11 or 14 wherein the heating means includes heating elements within the chamber.

23. An apparatus as claimed in claim 22, wherein the heating means includes electrical heating elements within the chamber.

24. An apparatus as claimed in claim 1, wherein the variable volume chamber includes circulation means for admitting a fluid to the chamber, and circulating that fluid around the chamber to enhance heat transfer to the material within the chamber.

25. An apparatus as claimed in claim 24, wherein the circulation means comprises an air circuit, for admitting air to the variable volume chamber, and for circulating air around the chamber.

26. An apparatus as claimed in claim 25, wherein the air circuit includes tubes extending across the variable volume chamber, the tubes being provided with openings for admitting air to the chamber.

27. An apparatus as claimed in claim 26, wherein the air circuit includes a fan for circulating air.

28. An apparatus as claimed in claim 27, wherein the air circuit further includes a heater for heating the circulating air.

29. An apparatus as claimed in claim 28, which includes at least one tube extending adjacent a bottom of the variable bottom chamber and serving to withdraw circulating air from the chamber and connected via the heater to an inlet of the circulation fan, and at least one tube extending near the top of the chamber and connected to an outlet of the circulation fan.

30. An apparatus as claimed in claim 25, wherein the heating means comprises a steam generator, and heat transfer elements located within the variable volume chamber and connected to the steam generator, the heat transfer elements providing heat transfer surfaces for heating material within the variable volume chamber.

31. An apparatus as claimed in claim 30, wherein the heat transfer elements comprise elongate tubes extending generally parallel to one another across the interior of the variable volume chamber.

32. An apparatus as claimed in claim 30, wherein the heat transfer elements comprise panels formed from two sheets of material, between which a plurality of passageways for the heating fluid are defined.

33. An apparatus as claimed in claim 32, wherein each panel has an inlet at its upper end for steam, and an outlet at its lower end for condensate both of which communicate with the passageways within the panel, and wherein the variable volume chamber is provided with a steam inlet pipe at its upper end, which is connected to the steam inlets of the heating panels and to the steam generator, and a condensate collection chamber is provided at the bottom of the variable volume chamber, to which condensate collection chamber the condensate outlets of the panels are connected.

34. An apparatus as claimed in claim 32, wherein the heat transfer elements are cylindrical, and are disposed concentrically relative to one another.

35. An apparatus as claimed in claim 34, wherein each heat transfer element comprises a plurality of individual panels.

36. An apparatus as claimed in claim 24, wherein the fluid admitted by the circulation means is a heated fluid.

37. An apparatus as claimed in claim 1, wherein the heating means comprises a plurality of heating panels, each of which comprises two sheets bonded together to define channels extending across the heating panel, and an electrical resistance heating element threaded through those channels.

38. An apparatus for reducing the moisture content of a material, the apparatus comprising:

a variable volume chamber, adapted to receive such material for reducing the moisture content of the material, which variable volume chamber comprises side-walls, a bottom wall extending from the side-walls and inclined downwards to a material outlet, and a resilient diaphragm extending across the top of the side-walls to close the chamber;

heating means within the chamber arranged to heat the material by direct contact with the material; and pumping means connected to the chamber for pumping fluid from the chamber and capable of maintaining a sub-atmospheric pressure equivalent to at least 16 inches of mercury below atmospheric pressure in the chamber sufficient to substantially reduce heat input from the heating means required to heat material within the chamber;

the arrangement being such that, in use, the chamber is filled with material, the pumping means pumps fluid from the chamber to create a sub-atmospheric pressure therein, the variable volume chamber reduces in volume so that external pressure is transmitted to the material within the chamber and no substantial pressure load is carried by the walls of the chamber, and material within the chamber is heated by the heating means to cause vaporization of moisture in the material at a temperature below the boiling point of water at atmospheric pressure, the vaporized moisture being drawn off by the pumping means.

39. An apparatus for reducing the moisture content of a material, the apparatus comprising:

a variable volume chamber, adapted to receive such material for reducing the moisture content of the material, which variable volume chamber comprises side-walls, a bottom wall extending from the side-walls and inclined downwards to a material outlet, and a resilient diaphragm extending across the top of the side-walls to close the chamber;

heating means within the chamber arranged to heat the material by direct contact with the material;

a condenser connected to the variable volume chamber;

a water/vapor separator connected to the condenser and having one outlet for non-condensable fluid and another outlet for condensate; and pumping means connected to said one outlet of the water/vapor separator, for pumping fluid from the chamber through the condenser and through the separator, the pumping means being capable of maintaining a sub-atmospheric pressure equivalent to at least sixteen inches of mercury below atmospheric pressure in the chamber sufficient to substantially reduce heat input from the heating means required to heat material within the chamber;

the arrangement being such that, in use, the chamber is filled with material, the pumping means pumps fluid from the chamber to create a sub-atmospheric pressure therein, condensate is drawn off through the other outlet of the water/vapor separator, the variable volume chamber reduces in volumes so that external pressure is transmitted to the material within the chamber and no substantial pressure load is carried by the walls of the chamber, and material within the chamber is heated by the heating means to cause vaporization of moisture in the material at a temperature below the boiling point of water at atmospheric pressure, the vaporized moisture being drawn off by the pumping means.

40. An apparatus for reducing the moisture content of a material, the apparatus comprising:

a variable volume chamber, adapted to receive such material for reducing the moisture content of the material;

heating means within the chamber arranged to heat the material by direct contact with the material;

a condenser connected to the variable volume chamber;

a water/vapor separator connected to the condenser and having one outlet for non-condensable fluid and another outlet for condensate; and pumping means connected to said one outlet of the water/vapor separator, for pumping fluid from the chamber through the condenser and through the separator, the pumping means being capable of maintaining a sub-atmospheric pressure in the chamber sufficient to substantially reduce heat input from the heating means required to heat material within the chamber;

the arrangement being such that, in use, the chamber is filled with material, the pumping means pumps fluid from the chamber to create a sub-atmospheric pressure therein, condensate is drawn off through the other outlet of the water/vapor separator, the variable volume chamber reduces in volumes so that external pressure is transmitted to the material within the chamber and no substantial pressure load is carried by the walls of the chamber, and the material within the chamber is heated by the heating means to cause vaporization of moisture in the material at a temperature below the boiling point of water at atmospheric pressure, the vaporized moisture being drawn off by the pumping means.

41. An apparatus as claimed in claim 39 or 40, which includes a by-pass line connected between the variable volume chamber and the pumping means and by-passing the condenser, and a control valve in the by-pass line, which control valve can permit a controlled quantity of fluid to flow directly to the pumping means from the variable volume chamber.

42. An apparatus as claimed in claim 40, wherein the condenser is water cooled, and includes an inlet and an outlet for cooling water.

43. An apparatus as claimed in claim 42, wherein a supply auger is provided, for supplying material to the variable volume chamber.

44. An apparatus as claimed in claim 40, wherein the condenser is air cooled, and a fan is provided for cooling the condenser.

45. An apparatus as claimed in claim 44, which includes an input conveyor for grain passing to the variable volume chamber, and wherein the fan is located on one side of the condenser, and a duct is provided on the other side of the condenser extending between the condenser and the conveyor, to conduct air heated by passage through the condenser to the conveyor, thereby to preheat grain on the conveyor.

46. An apparatus as claimed in claim 45, wherein the conveyor is enclosed.

47. An apparatus as claimed in claim 46, wherein an outlet of the enclosed conveyor is connected to a supply auger which discharges material to the variable volume chamber.

48. An apparatus for reducing the moisture content of a material, the apparatus comprising:

a variable volume chamber adapted to receive such material for reducing the moisture therein, which variable volume chamber is cylindrical about a vertical axis and has regid side-walls;

heating means for heating the material by direct contact with the material comprising a plurality of cylindrical heating panels disposed concentrically within one another and within the variable volume chamber to define annular spaces for said material, each of which heating panels comprises two sheets bonded together to define channels extending across the panel for a heat source; and pumping means connected to the chamber for pumping fluid from the chamber and capable of maintaining a sub-atmospheric pressure equivalent to at least 16 inches of mercury below atmospheric pressure in the chamber sufficient to substantially reduce heat input from the heating means required to heat material within the chamber;

the arrangement being such that, in use, the chamber is filled with material, the pumping means pumps fluid from the chamber to create a sub-atmospheric pressure therein, the variable volume chamber reduces in volume so that external pressure is transmitted to the material within the chamber and no substantial pressure load is carried by the walls of the chamber, and material with the chamber is heated by the heating means to cause vaporization of moisture in the material at a temperature below the boiling point of water at atmospheric pressure, the vaporized moisture being drawn off by the pumping means.

* * * * *